US012653302B2

(12) United States Patent
Lee

(10) Patent No.: US 12,653,302 B2
(45) Date of Patent: Jun. 16, 2026

(54) STANDING DESK WITH MODULAR BASE

(71) Applicant: Rove Concepts Ltd., Vancouver (CA)

(72) Inventor: Art Lee, Vancouver (CA)

(73) Assignee: Rove Concepts. Ltd., Vancouver (CA)

( * ) Notice: Subject to any disclaimer, the term of this patent is extended or adjusted under 35 U.S.C. 154(b) by 96 days.

(21) Appl. No.: 18/413,832

(22) Filed: Jan. 16, 2024

(65) Prior Publication Data

US 2025/0228355 A1 Jul. 17, 2025

(51) Int. Cl.
*A47B 9/20* (2006.01)
*A47B 21/02* (2006.01)

(52) U.S. Cl.
CPC ..... *A47B 9/20* (2013.01); *A47B 21/02* (2013.01)

(58) Field of Classification Search
CPC ..... A47B 9/20; A47B 21/02
USPC ..... 108/147.19
See application file for complete search history.

(56) References Cited

U.S. PATENT DOCUMENTS 3,698,150 A * 10/1972 Anderson ..... A47B 91/00 249/188
4,799,735 A * 1/1989 Meyer ..... A47C 7/00 297/445.1
5,024,167 A * 6/1991 Hayward ..... A47B 17/003 108/50.02
5,335,471 A * 8/1994 Kupiec ..... G02B 6/0096 52/28
5,357,874 A * 10/1994 Palmer ..... A47B 21/06 108/50.02
5,495,811 A * 3/1996 Carson ..... A47B 9/20 108/147
5,673,882 A * 10/1997 Huang ..... A47B 17/00 248/188.8
6,705,239 B2 * 3/2004 Doyle ..... A47B 9/04 108/147
7,392,966 B1 * 7/2008 Chen ..... A47B 91/00 248/188.8
8,015,775 B2 * 9/2011 McMullen ..... E04C 3/36 52/170
9,345,319 B1 * 5/2016 Heuel ..... A47B 97/00
9,565,928 B2 * 2/2017 Kassanoff ..... G06F 1/16
9,999,295 B1 * 6/2018 Game ..... A47B 9/20
10,028,576 B1 * 7/2018 Yao ..... A47B 9/20
10,499,729 B1 * 12/2019 Lavoie ..... A47B 9/16
D873,055 S * 1/2020 Kitada ..... D6/656.17
10,980,338 B1 * 4/2021 Marion ..... A47B 13/081
11,140,978 B1 * 10/2021 Baker ..... A47B 96/20
11,346,111 B1 * 5/2022 Purpus ..... E04F 13/0733
11,491,636 B2 * 11/2022 Maturo ..... A47B 21/03
11,503,905 B2 * 11/2022 Matthai ..... A47B 21/06
(Continued)

*Primary Examiner* — Daniel J Troy
*Assistant Examiner* — Timothy M Ayres
(74) *Attorney, Agent, or Firm* — Dentons Durham Jones Pinegar; Sarah W. Matthews; Lilly Godfrey

(57) ABSTRACT

This disclosure relates generally to a standing desk base comprising. The base includes a first shell comprising a first frame, a first top plate attachable to the first frame, and a first outer cover disposed about an exterior of the first frame. A second shell is joinable to the first shell and comprises a second frame, a second top plate attachable to the second frame, and a second outer cover disposed about an exterior of the second frame. The first shell and the second shell are positionable about a leg of a standing desk to form a standing desk base.

14 Claims, 22 Drawing Sheets

(56) References Cited

U.S. PATENT DOCUMENTS

| | | | | |
|---|---|---|---|---|
| 11,696,639 | B2 * | 7/2023 | Cvek | H02G 3/34 439/532 |
| 2006/0185270 | A1 * | 8/2006 | Handley | E04C 3/30 52/169.14 |
| 2014/0312754 | A1 * | 10/2014 | Hecht | A47B 83/045 312/317.3 |
| 2017/0292275 | A1 * | 10/2017 | Taylia | E04F 13/0894 |
| 2024/0306809 | A1 * | 9/2024 | Cameron | H01B 7/065 |

* cited by examiner

STANDING DESK WITH MODULAR BASE

TECHNICAL FIELD

This disclosure relates generally to standing desks having modular bases.

SUMMARY

Disclosed are systems, devices, and/or methods of use thereof regarding standing desks having modular decorative bases. In various aspects, a standing desk base includes a first shell having a first frame, a first top plate attachable to the first frame, and a first wrapper disposed about an exterior of the first frame. The standing desk base also includes a second shell having a second frame, a second top plate attachable to the second frame, and a second wrapper disposed about an exterior of the second frame. The second shell may be joinable to the first shell and may be substantially identical to the first shell. The first and second shells may be positionable about a leg of a standing desk and form the standing desk base when (i) the first shell is positioned about the leg of the standing desk, (ii) the second shell is positioned about the leg of the standing desk, and (iii) the first shell is joined to the second shell.

In various aspects, a modular standing desk includes a desktop, a first leg extending from a base of the desktop, and a second leg extending from the base of the desktop, the first and second legs symmetrically extending from the base. The modular standing desk also includes a first casing removably surround the first leg and a second casing removably surrounding the second leg, where the first and second casings are substantially identical and interchangeable with each other.

In various aspects, a standing desk kit includes a desktop, a pair of legs attachable to the desktop, and a decorative base for covering at least a portion of each leg of the pair of legs. The decorative base may include a first shell for encasing a first leg and a second shell for encasing a second leg. The first and second shells may be interchangeable with each other and at least one of the first and second shells incudes hidden storage (e.g., a shelf, drawer, etc.). The decorative base may be bottomless to accommodate the pair of legs.

In various aspects, a method of assembling a standing desk may include attaching a first leg to a first end of an underside of a desktop and attaching a second leg to a second end opposite the first end of the underside of the desktop. The method may also include positioning a first casing about the first leg, where the first casing incudes a first shell half having a frame and an outer cover and a second shell half connectable to the first shell half, the second shell half having a frame and an outer cover. The method may further include positioning a second casing about the second leg, where the second casing is substantially identical to the first casing. The first and second casings may form a decorative base for the standing desk.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
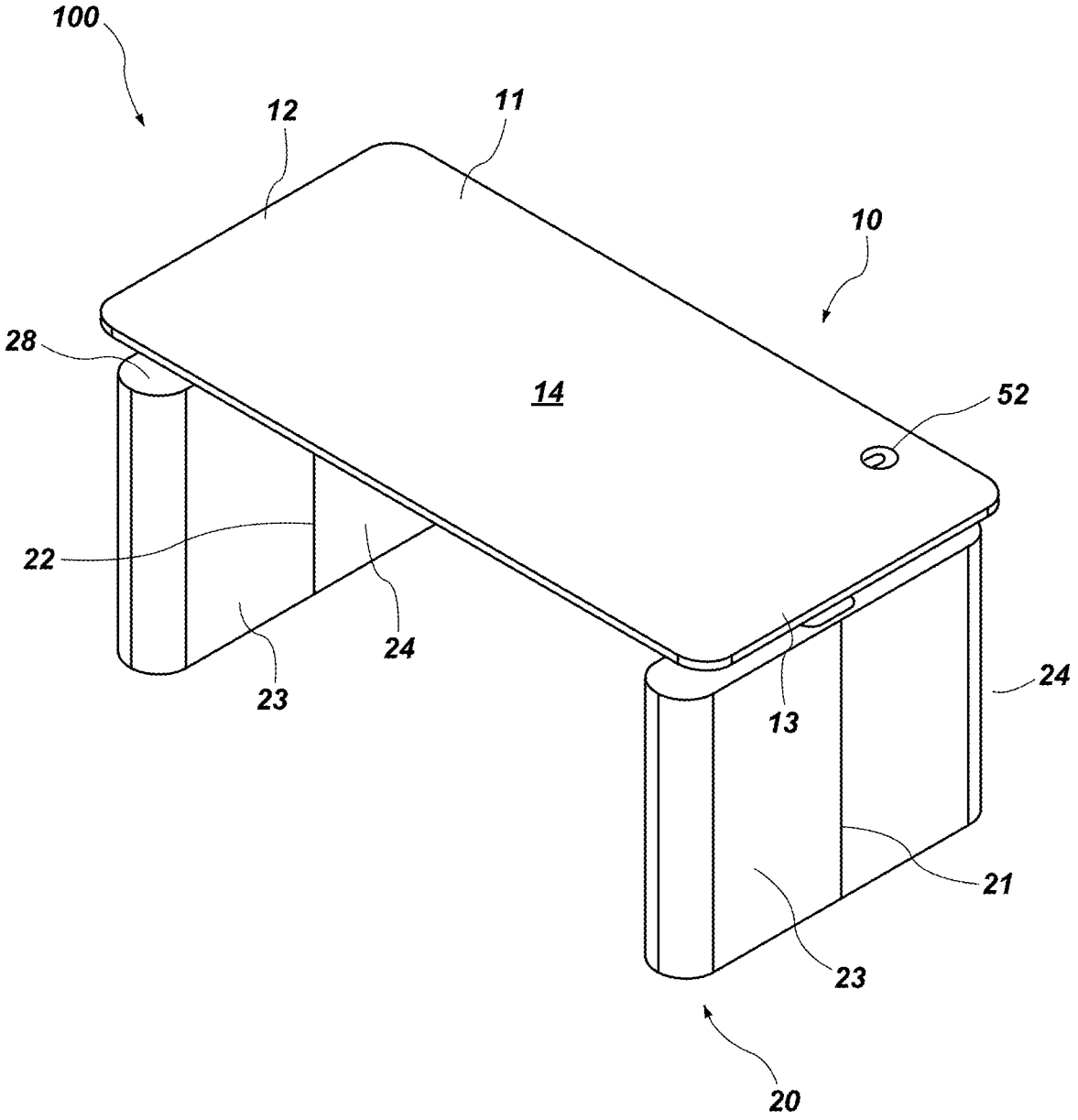
FIG. 1 illustrates a perspective view of a standing desk having a base.

Many standing desks on the market today are utilitarian in both function and design. Often, this utilitarian design results in standing desks that have exposed mechanical parts (such as cables or other wiring) and telescoping legs. For example, to accomplish the goal of providing a desk at different heights, the standing desks typically incorporate telescoping legs. The telescoping legs are generally not modified to be more aesthetically pleasing and these legs are usually left uncovered, resulting in a functional but unaesthetic desk.

FIGS. 1 through 5 illustrate views of a standing desk system 100 having a standing desk 10 and a modular base 20. The standing desk 10 includes a desktop 11, having a top surface 14 and a bottom surface 15 opposite the top surface 14, and a pair of legs including a first leg 17 and a second leg 18 (see FIGS. 3A-3B). The first leg 17 may be secured to the bottom surface 15 at a first end 12 of the desktop 11 and the second leg 18 may be secured to the bottom surface 15 at a second end 13 opposite the first end 12 of the desktop 11.

Figure 2:
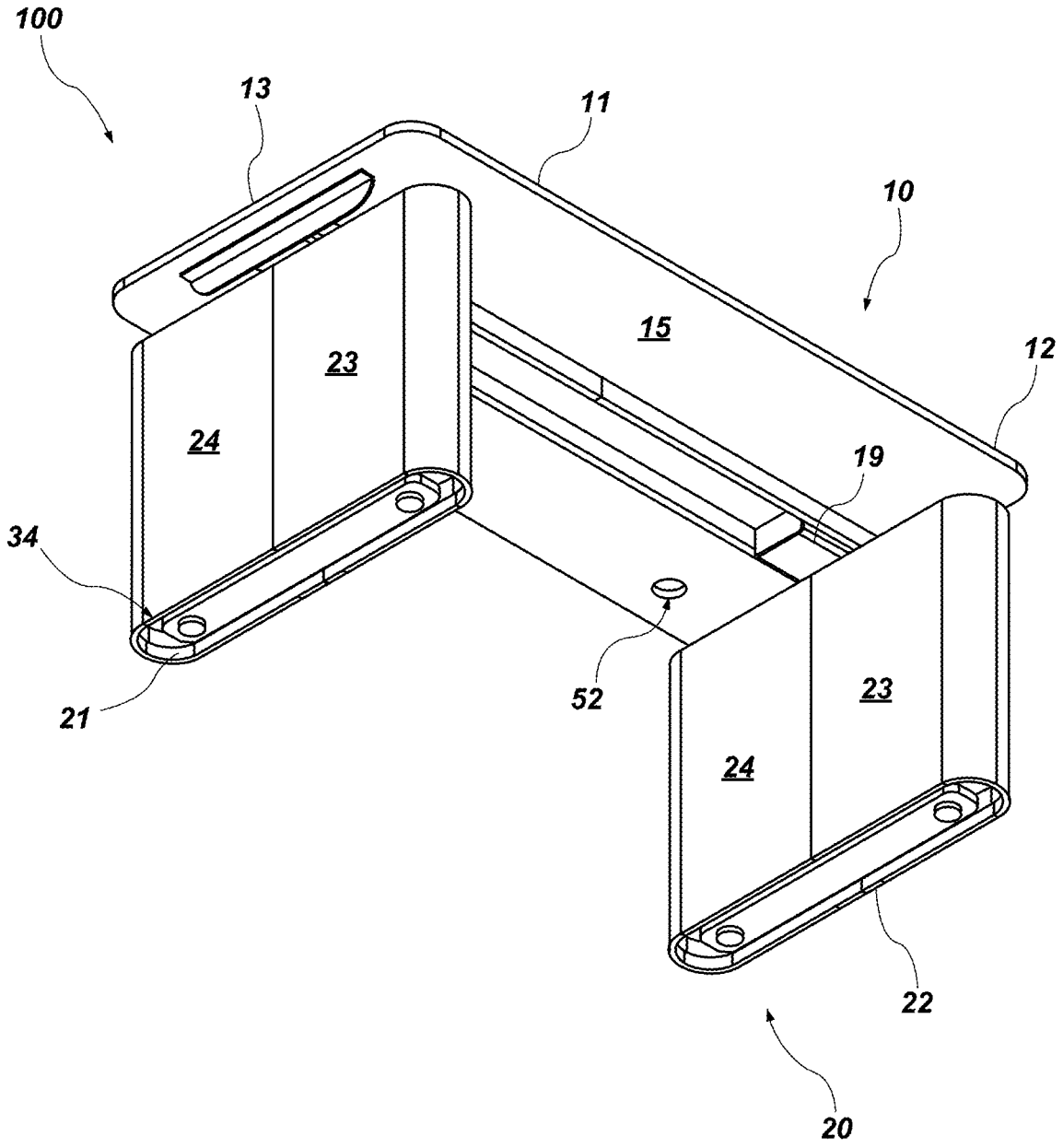
FIG. 2 illustrates a bottom perspective view of the standing desk from FIG. 1.
Figure 3A:
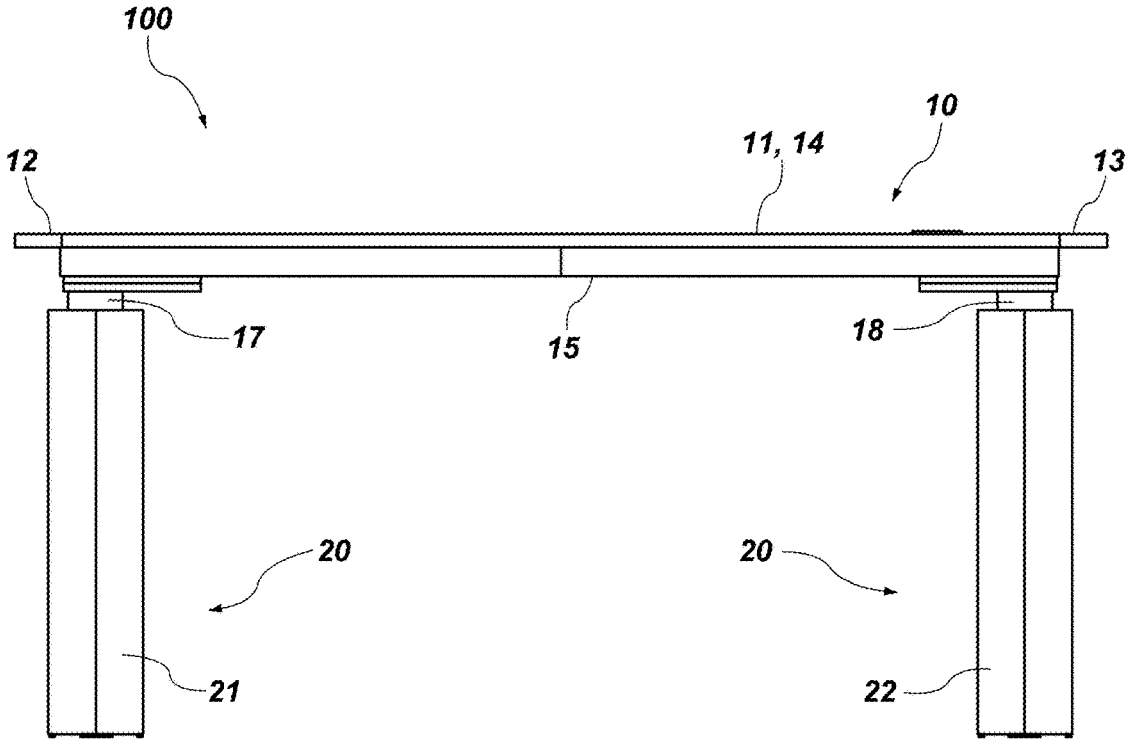
FIG. 3A illustrates a front view of the standing desk of FIG. 1
Figure 3B:
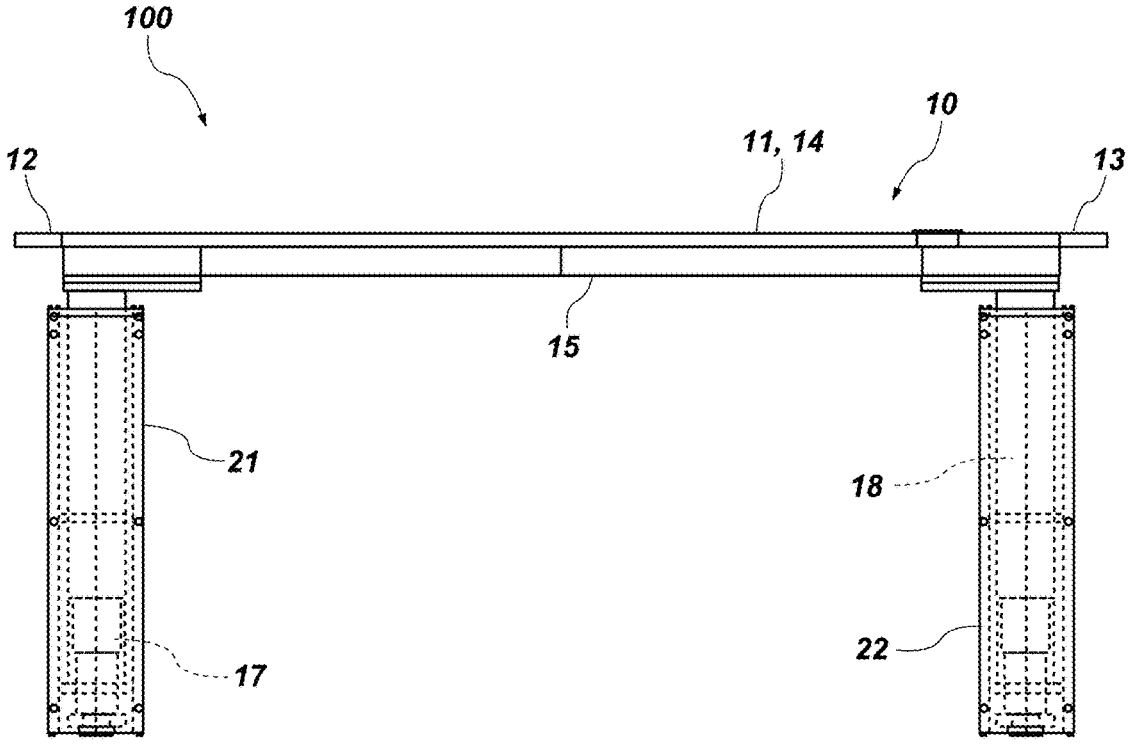
FIG. 3B illustrates a front view of the standing desk with the base being transparent.
Figure 4A:
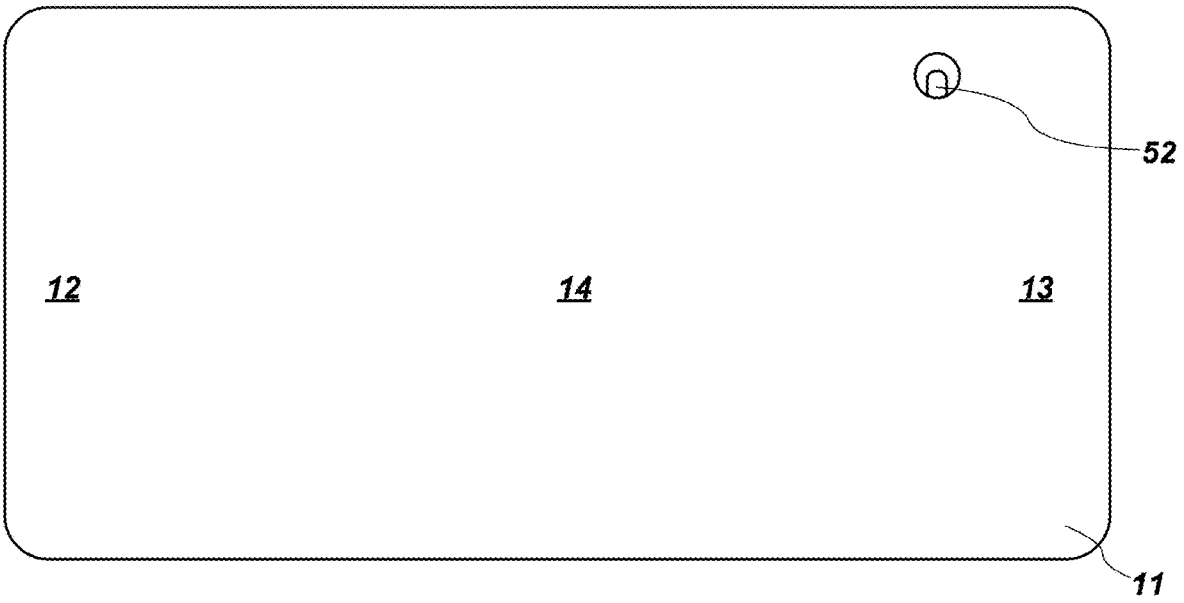
FIGS. 4A and 4B illustrate top views of the standing desk of FIG. 1.
Figure 4B:
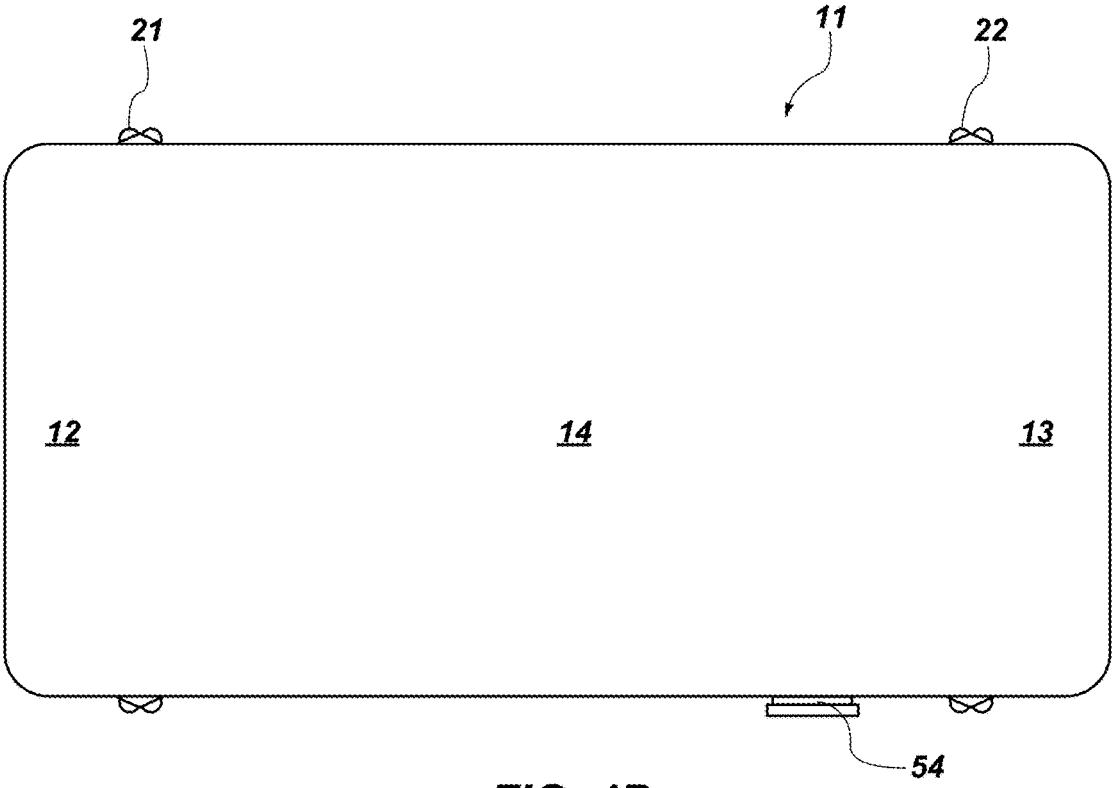
Figure 5A:
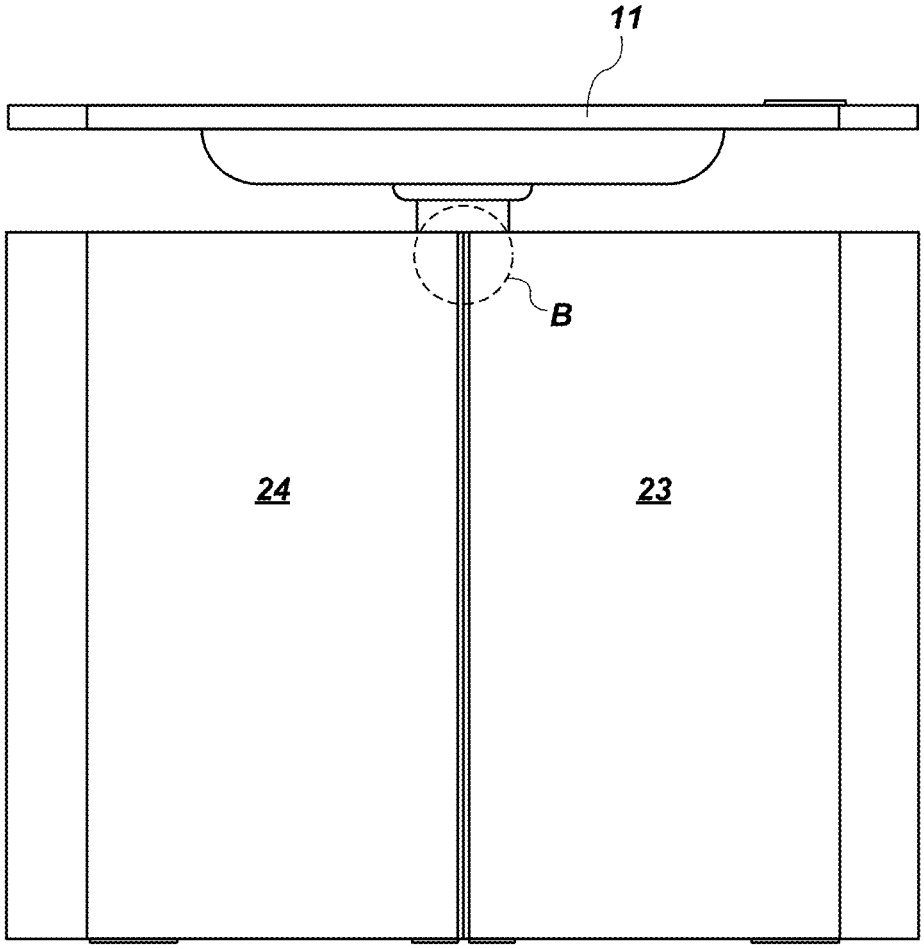
FIG. 5A illustrates an end view of the standing desk of FIG. 1
Figure 5B:
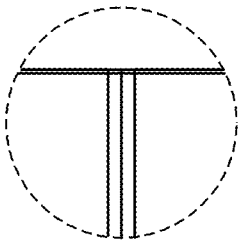
FIG. 5B illustrates a close-up view of a connection from FIG. 5A.
Figure 14A:
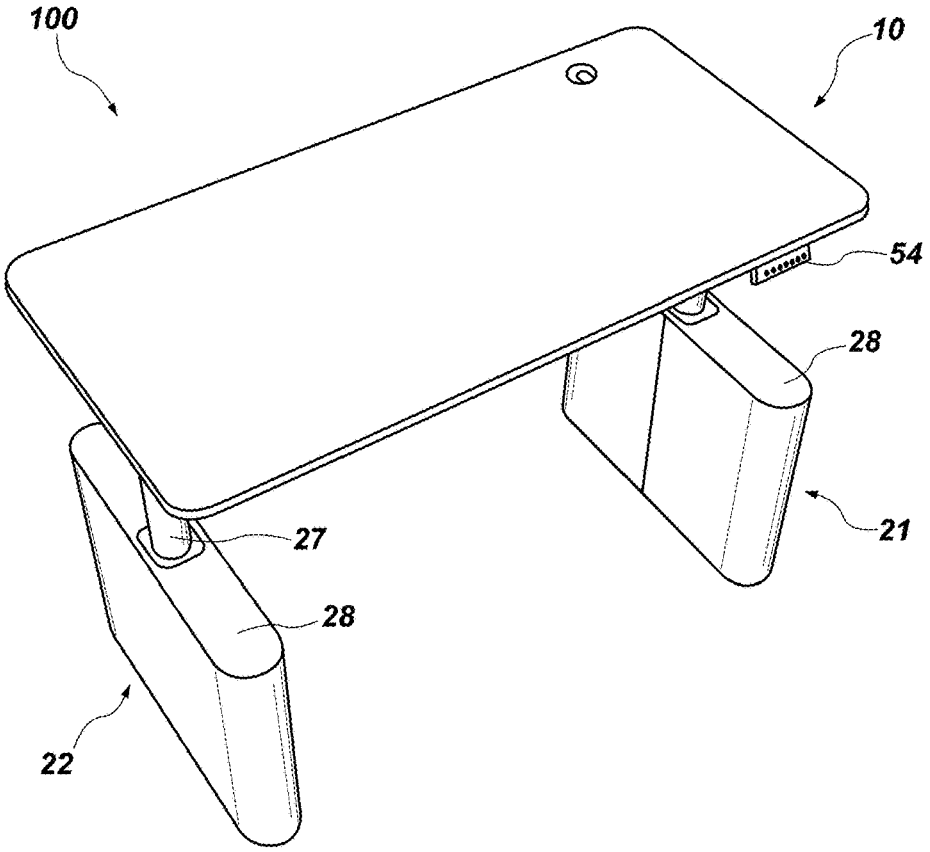
FIGS. 14A and 14B illustrate the standing desk of FIG. 1 in an extended position.
Figure 14B:
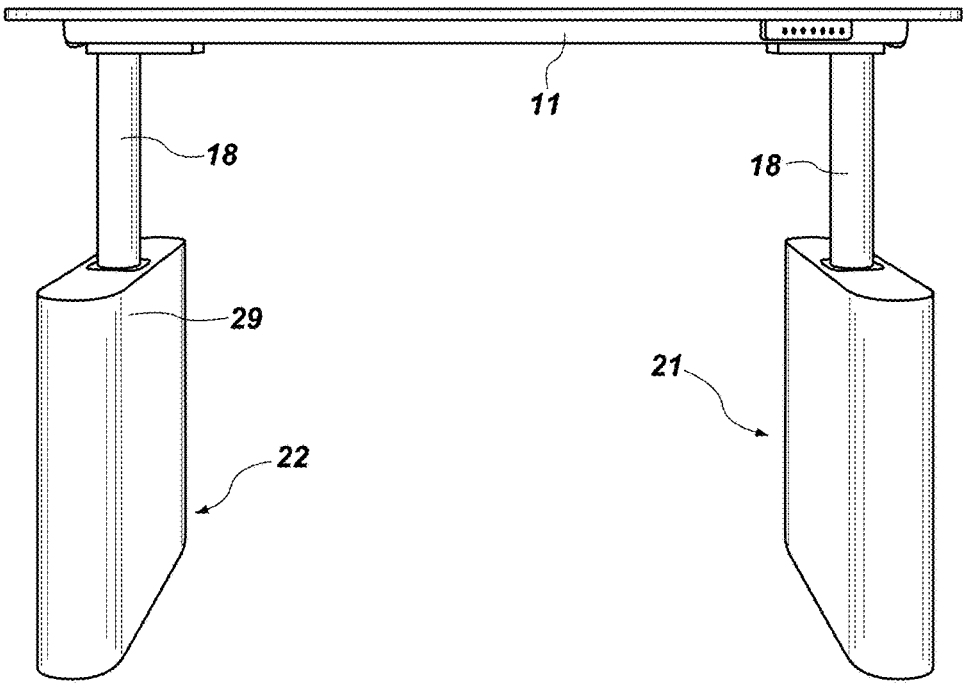

In some embodiments, the legs 17, 18 are securable or attachable to the bottom surface 15 through a mount or framework 19 (see FIG. 2). The mount/framework 19 may include brackets or other structures to facilitate attachment of the legs 17, 18 to the desktop 11. Alternatively, the legs 17, 18 may be directly securable or attachable to the bottom surface 15 of the desktop 11. The legs 17, 18 may be telescoping legs, extending from a leg base 17*b*, 18*b* (FIG. 6A) to the bottom surface 15 of the desktop 11 and allowing the standing desk 10 to have a plurality of differing heights. For example, as illustrated in FIGS. 1 to 3B, the standing desk 10 may have a minimum height where the legs 17, 18 are in a fully contracted configuration (best seen in FIG. 3B). The standing desk 10 may also have a maximum height where the legs 17, 18 are in a fully extended configuration (best seen in FIG. 14B). As the legs 17, 18 are telescoping, the standing desk 10 also has a myriad of medium height configurations between the minimum and maximum heights. The standing desk 10 may include controls 54 to facilitate the setting of a height and the transition between heights (see FIG. 4B).

The modular base 20 includes a first casing or shell 21 and a second casing or shell 22. The first casing 21 may be disposed around the first leg 17, thereby encasing and covering the first leg 17. Similarly, the second casing 22 may be disposed around the second leg 18, thereby encasing and covering the second leg 18. The first and second casings 21, 22 may be "bottomless," in that the casings 21, 22 surround and encase the legs 17, 18, but the leg bases 17*b*, 18*b* rest on the floor and are accessible from the bottom of the casings 21, 22 (see FIGS. 6A and 6B). This allows the standing desk system 100 to be moved without removing the modular base 20 and allows the modular base 20 to be switched out with a different modular base 20 without needing to disassemble the standing desk 10. In other configurations, the first and second casings 21, 22 may be provided with a bottom.

Figure 6A:
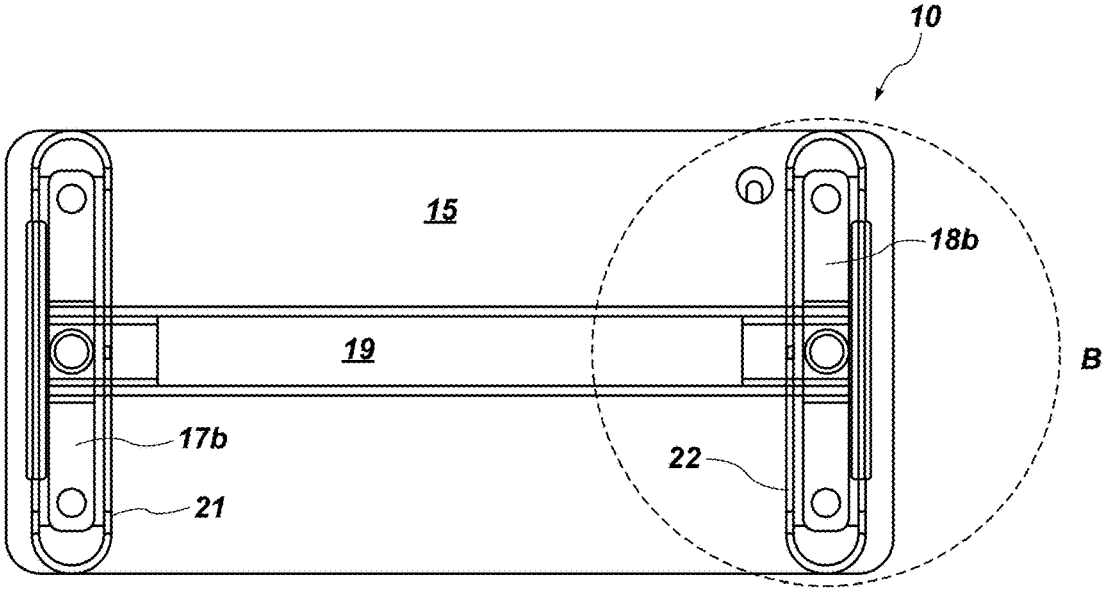
FIG. 6A illustrates a bottom view of the standing desk of FIG. 1
Figure 6B:
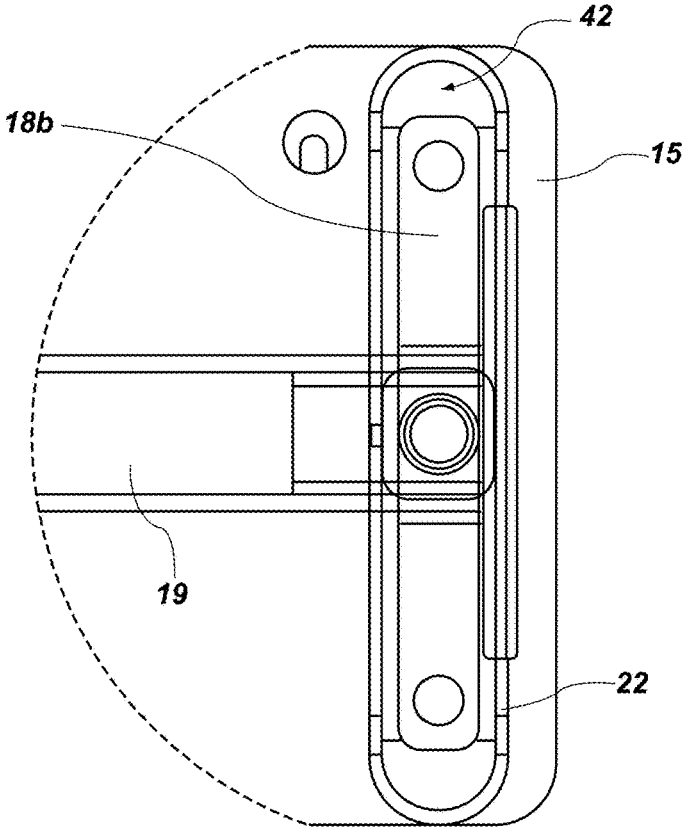
FIG. 6B illustrates a close-up view of the bottom of the base from FIG. 6A.

In one embodiment, illustrated in FIGS. 6A and 6B, each leg base 17*b*, 18*b*, is enclosed by the first casing 21 and the second casing 22, respectively, within a cavity 42 defined by the first casing 21 and the second casing 22. A width of the cavity 42 defined by the first casing 21 and the second casing 22 may correspond to the width of the leg base 17*b*, 18*b*, such that the leg base 17*b*, 18*b* may be contained within the first and/or second casing 21, 22, and rest on a surface, such as a floor. That is, the cavities 42 may be slightly wider than each leg base 17*b*, 18*b* to accommodate each leg base 17*b*, 18*b*. Each leg base 17*b*, 18*b*, may have a width ranging from about 10 cm to about 15 cm, such as 11, 12, 13, or 14 cm, or a width within a range defined by any two of the foregoing values.

Additionally, the cavities 42 may have a length that corresponds to (e.g., is slightly longer than) a length of the leg bases 17*b*, 18*b*. Each leg base 17*b*, 18, may have a length ranging from about 25 cm to about 35 cm, such as 27, 29, 31, or 33 cm, or a length within a range defined by any two of the foregoing values.

The modular base 20 may also be provided with decorative features, making the standing desk 10 more aesthetically pleasing overall. Additionally in some embodiments, the base 20 is modular, where the first casing 21 and the second casing 22 can be changed out as desired, meaning the overall aesthetics of the standing desk 10 may be changed as desired (e.g., to match the décor of a room or office, etc.). Additionally, the first casing 21 and the second casing 22 are substantially identical and therefore interchangeable, meaning that the first casing 21 could be disposed about the second leg 18 and the second casing 22 could be disposed about the first leg 17.

In some embodiments, each of the first casing 21 and the second casing 22 includes a first shell half 23 and a second shell half 24 that is securable, attachable, and/or connectable to the first shell half 23. When the first shell half 23 is joined to the second shell half 24, the first leg 17, or the second leg 18, is substantially fully contained within the first or second casing 21, 22. The first and second casings 21, 22 encase the first and second legs 17, 18, respectively, in such a manner as to preserve the telescoping action of the first and second legs 17, 18. Specifically, the first and second casings 21, 22 encase the first and second legs 17, 18, respectively, in such a manner that allows the first and second legs 17, 18 to telescope to various heights during use of the standing desk 10 while the first and second legs 17, 18 are encased in the first and second casings 21, 22, respectively.

Figure 7:
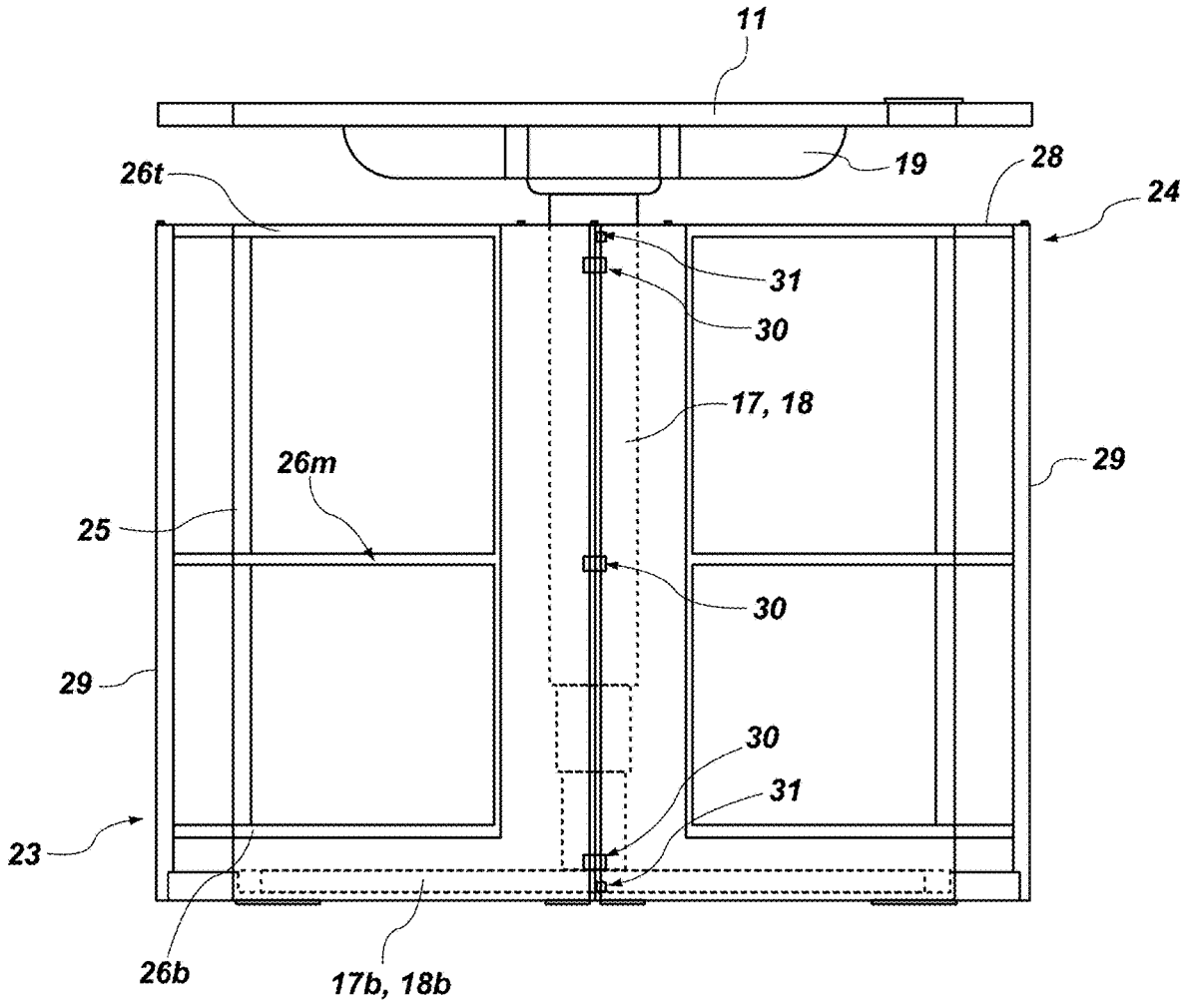
FIG. 7 illustrates the end view of FIG. 5A where the base is transparent to see a leg of the standing desk received within the base.

As seen in FIG. 7, each of the first shell half 23 and the second shell half 24 include a frame 25 and an outer cover 29 securable to the frame 25. For example, the frame 25 may have an exterior and the outer cover 29 is securable to the exterior of the frame 25 (e.g., through an adhesive, fasteners, a snap or clip-in fit, etc.). The outer cover 29 may be decorative, such as including patterns, paneling, brass or other finishes, wood grain, etc. (see FIGS. 18A to 21B). In some embodiments, the frame 25 may be integrally formed with the outer cover 29. The frame 25 may include one or more tiers 26, such as a bottom tier 26*b*, a middle tier 26*m*, and a top tier 26*t*. Each tier 26 may include or define a cut-out 27 (FIGS. 8-10) sized and shaped to accommodate the first or second leg 17, 18. Alternatively, the frame 25 may include a bottom tier 26*b* and a top tier 26*t* or may not include tiers 26. In yet other embodiments, the frame may include more than three tiers.

The first and second casing 21, 22 also include a finishing or top plate 28. The top plate 28 may attach to the top tier 26*t*; alternatively, the top plate 28 may be the top tier 26*t*. The top plate 28 may match any decorative elements present on the outer cover 29 and/or may provide the first and second casings 21, 22 with a "finished" look. In other embodiments, the top plate 28 may be integral to the first and second casing 21, 22. Or the top plate 28 may be integral to the outer cover 29.

The first shell half 23 may include one or more (e.g., a plurality) of connections 30 or couplings that may correspond to one or more connections 30 or couplings of the second shell half 24. The one or more connection 30 are for joining the first shell half 23 with the second shelf half 24 when the base 20 is assembled. The one or more connections 30 may be magnetic connections, detent and pin connections, snaps, clips, fasteners, or any other appropriate mechanical connection or coupling. When the one or more connections 30 include magnetic connections, they may be formed of strong magnetic materials to facilitate a strong and secure connection between the first shell half 23 and the second shell half 24. Additionally, the first shell half 23 may include one or more pins or dowels 31 that mate or engage with one or more holes 32 of the second shell half 24. The pins 31 and holes 32 may supplement the connections 30 for the first and second shell halves 23, 24. In other embodiments, the first shell half 23 may be attached or joinable to the second shell half 24 through any other suitable means. In some embodiments, the connection between the first shell half 23 and the second shell half 24 is a reversible connection, allowing the first and second halves 23, 24 to be easily removed by a user.

Figure 8:
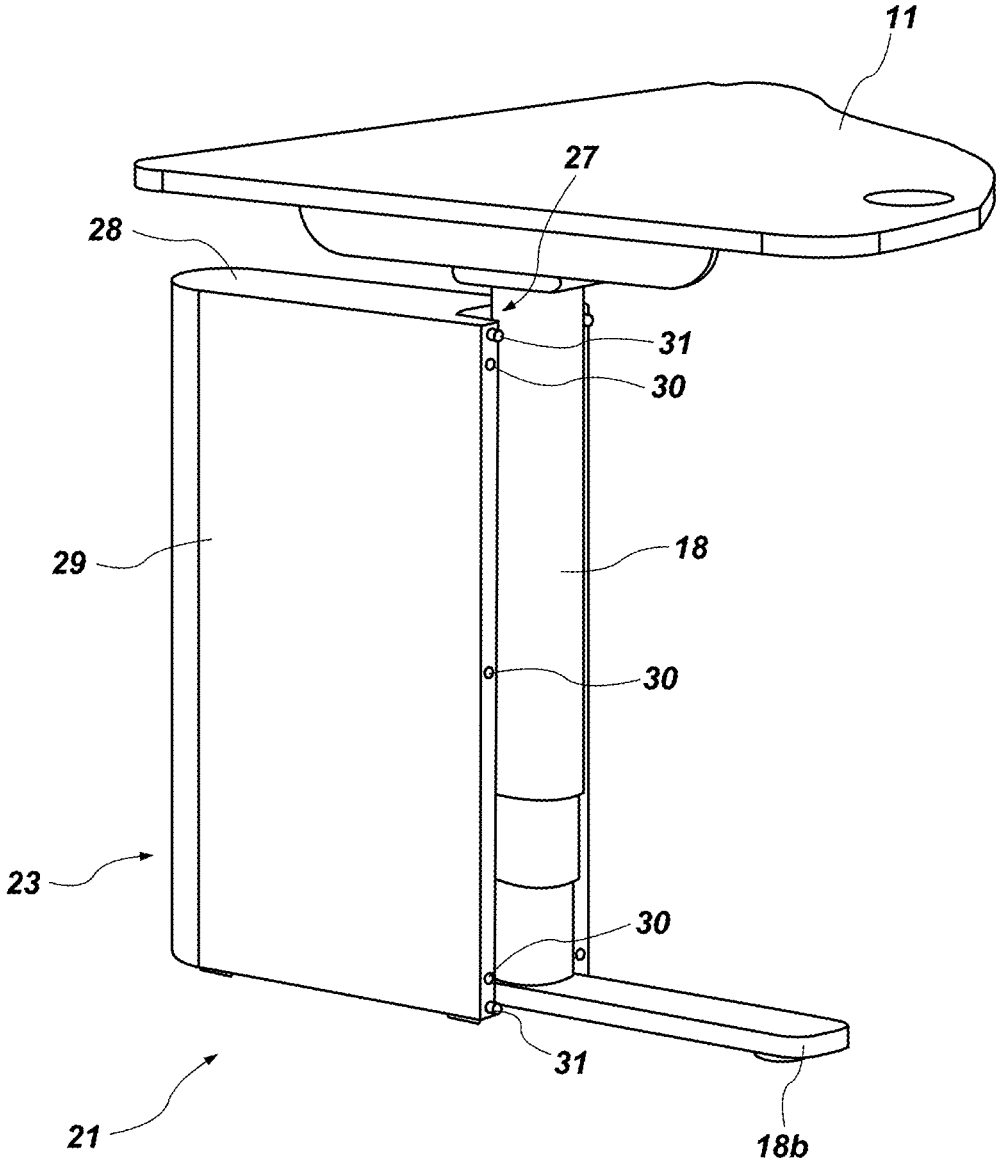
FIG. 8 illustrates a perspective end view of the standing desk from FIGS. 1-7 with a portion of the base removed to see a leg of the standing desk received within the base.

FIG. 8 illustrates a perspective end view of the standing desk 10 from FIGS. 1 through 7 with a portion of the first casing 21 removed to see a leg of 18 the standing desk 10 received within a portion of the base 20. Specifically, as illustrated, the second leg 18 is partially received within a first shell half 23 of the first or second casing 21, 22; the first shell half 23 is substantially identical to the second shell half 24 (not illustrated). As before, the first shell half 23 includes an outer cover 29 attached to a frame 25 (which may or may not have tiers 26). The outer cover 29 may extend beyond the frame 25 and/or the bottom tier 26*b* to encase the leg base 18*b* while still allowing the leg base 18*b* to rest on a surface, such as a floor. That is, the outer cover 29 may extend beyond the frame 25 and/or the bottom tier 26*b* to create a "bottomless" first shell half 23 and/or second shell half 24.

A finishing or top plate 28 may be attached to the top tier 26*t* of the frame 25 (see FIG. 7) or may be the top of the frame 25. The top plate 28 may include or define a cut-out 27 to accommodate the presence of the second leg 18. As before, the first shell half 23 may include one or more connections 30 to secure the first shell half 23 to the second shell half 24. The first shell half 23 may also include one or more pins or dowels 31 that mate or engage with one or more holes 32 of the second shell half 24.

Figure 9:
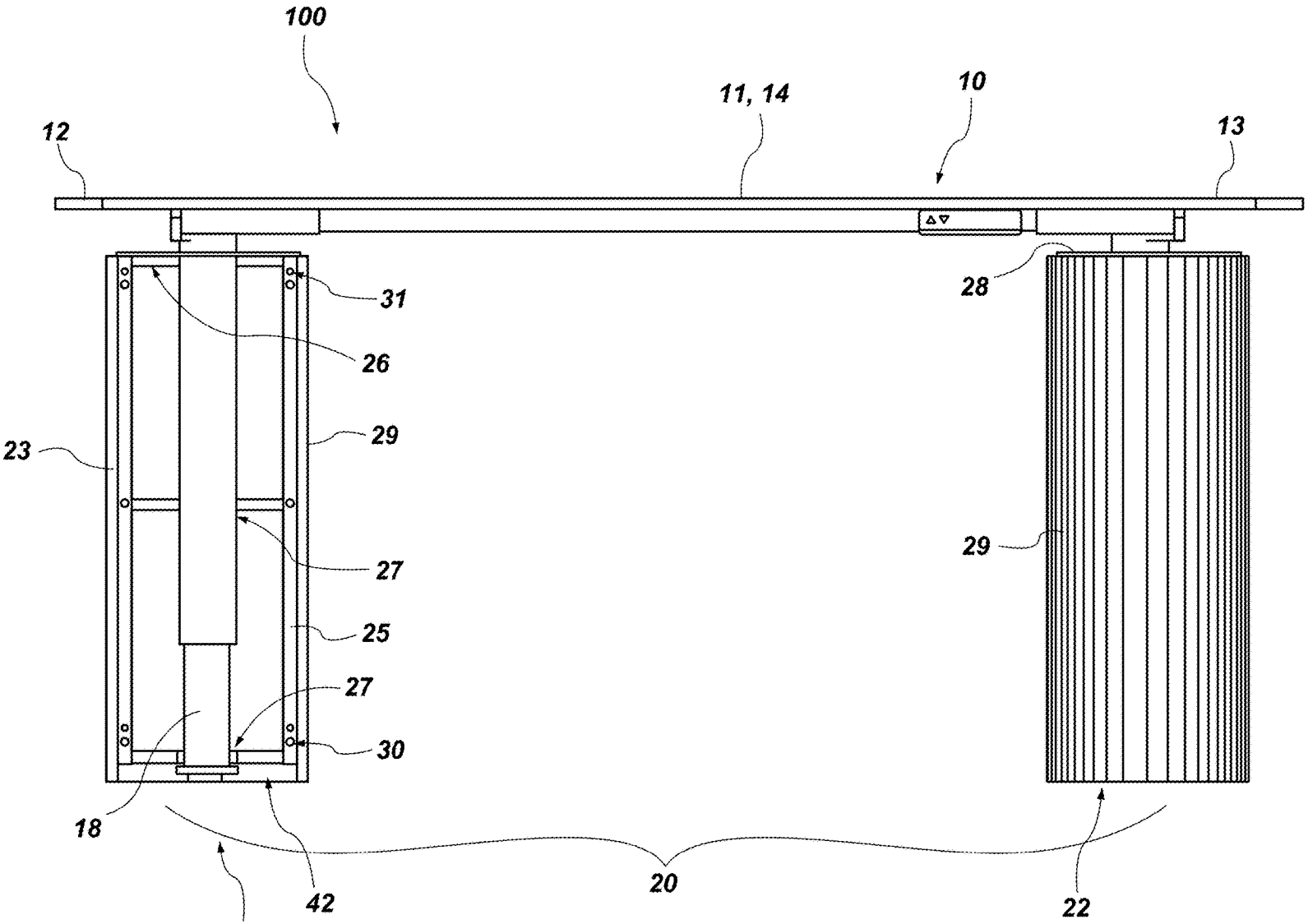
FIG. 9 illustrates another front view of the standing desk of FIG. 1, where a portion of the base is illustrated in cross-section.

FIG. 9 illustrates another front view of the standing desk system 100 of FIGS. 1 through 7, where a portion of the base 20 is removed for clarity. Specifically, the first shell half 23 of the first casing 21 is illustrated such that the leg 18 can be seen at least partially housed within the first shell half 23. The second shell half 24 has been omitted so the internal elements and structure of the first shell half 23 can be clearly seen (understanding that the second shell half 24 has similar and/or identical internal elements and structure). As before, the standing desk system 100 includes the standing desk 10 and the modular base 20. The modular base 20 includes the first casing 21 and a second casing 22, each configured to surround and encase the legs (a first leg 17 and a second leg 18) of the standing desk 10. The first casing 21 and the second casing 22 are substantially identical such that they are interchangeable with each other. Each of the first casing 21 and the second casing 22 include a first shell half 23 connectable to a second shell half 24. The first and second shell halves 23, 24 are also substantially identical and may be interchanged with each other. In other configurations, the first casing 21 and the second casing 22 can be formed of a single piece rather than two separate halves.

Each of the first shell half 23 and the second shell half 24 include a frame 25 and an outer cover 29 securable to the frame 25. The one or more connections 30, the pins or dowels 31, and the holes 32 to mate with the pins or dowels 31 may be incorporated into the frame 25 to secure the first shell half 23 to the second shell half 34. As illustrated in FIG. 9, the outer cover 29 includes paneling such that the modular base 20 appears to have wood paneling decoration. The frame 25 may include one or more tiers 26, such as a bottom tier 26*b*, a middle tier 26*m*, and a top tier 26*t* (see also FIG. 7). Each tier 26 may define a cut-out 27 sized and shaped to accommodate the leg 17, 18. Each tier 26 may have a thickness ranging from approximately 1 to 2 mm, such as 1.2, 1.3, 1.5, 1.8 mm, or a thickness within a range defined by any two of the foregoing values. The outer cover 29 extends beyond the bottom tier 26*b* to create or define a cavity 42, providing the first and second casings 21, 22 with a "bottomless" configuration. This "bottomless" configuration accommodates the base 17*b*, 18*b* of the legs 17, 18.

Figure 22:
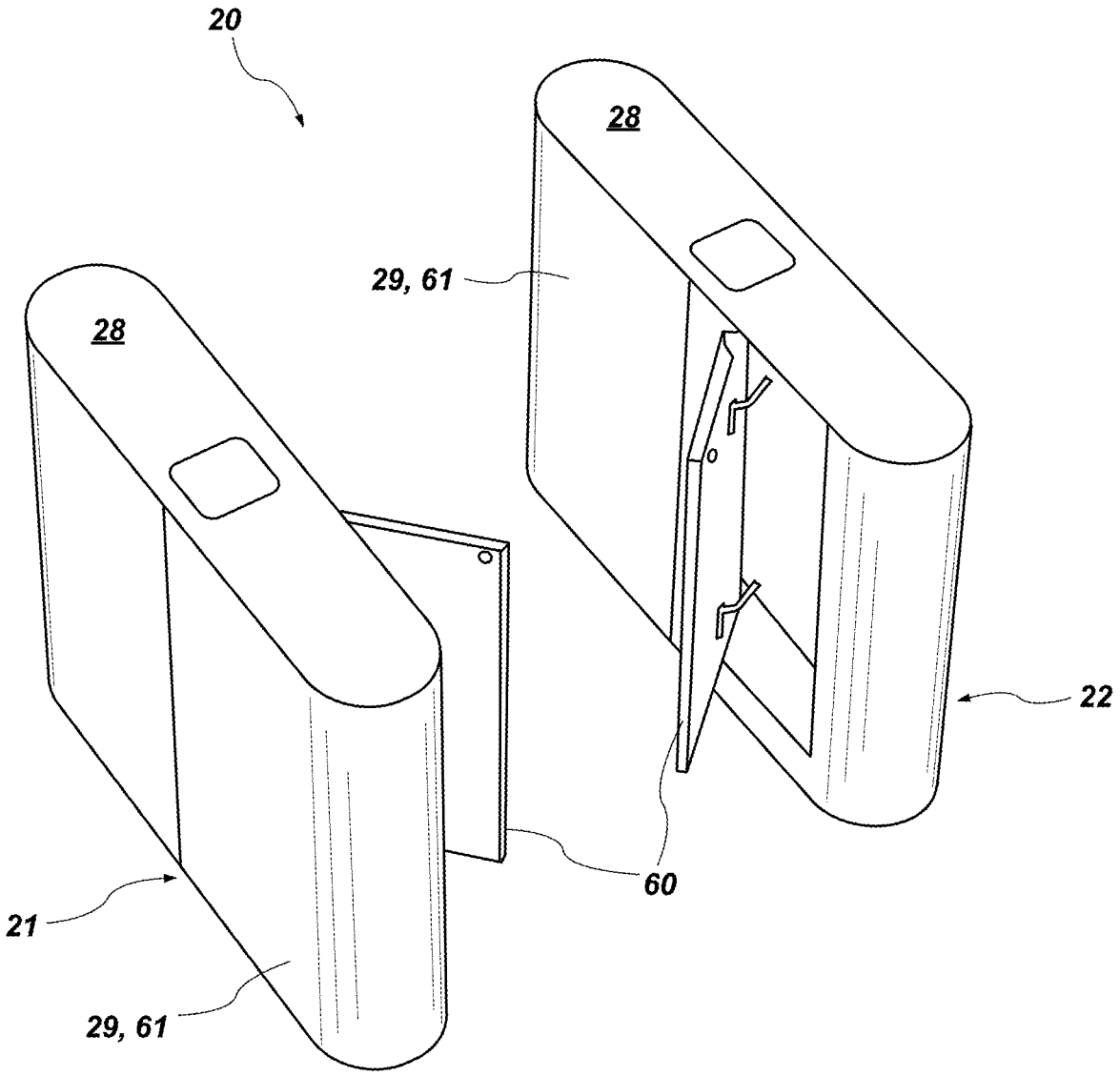
FIG. 22 illustrates a top, perspective view of a base having storage capabilities.

In some embodiments, the first casing 21 and/or the second casing 22 may include one or more storage capabilities, such as shelving or drawers. For example, referring briefly to FIG. 22, the outer cover 29 of the first casing 21 and/or the second casing 22 may include a door 60 hingedly attached to one or more static panels 61. The door(s) 61 may open into the cavity 40 defined by the outer cover 29. In some embodiments, the tiers 26 may act as storage shelves.

Figure 10:
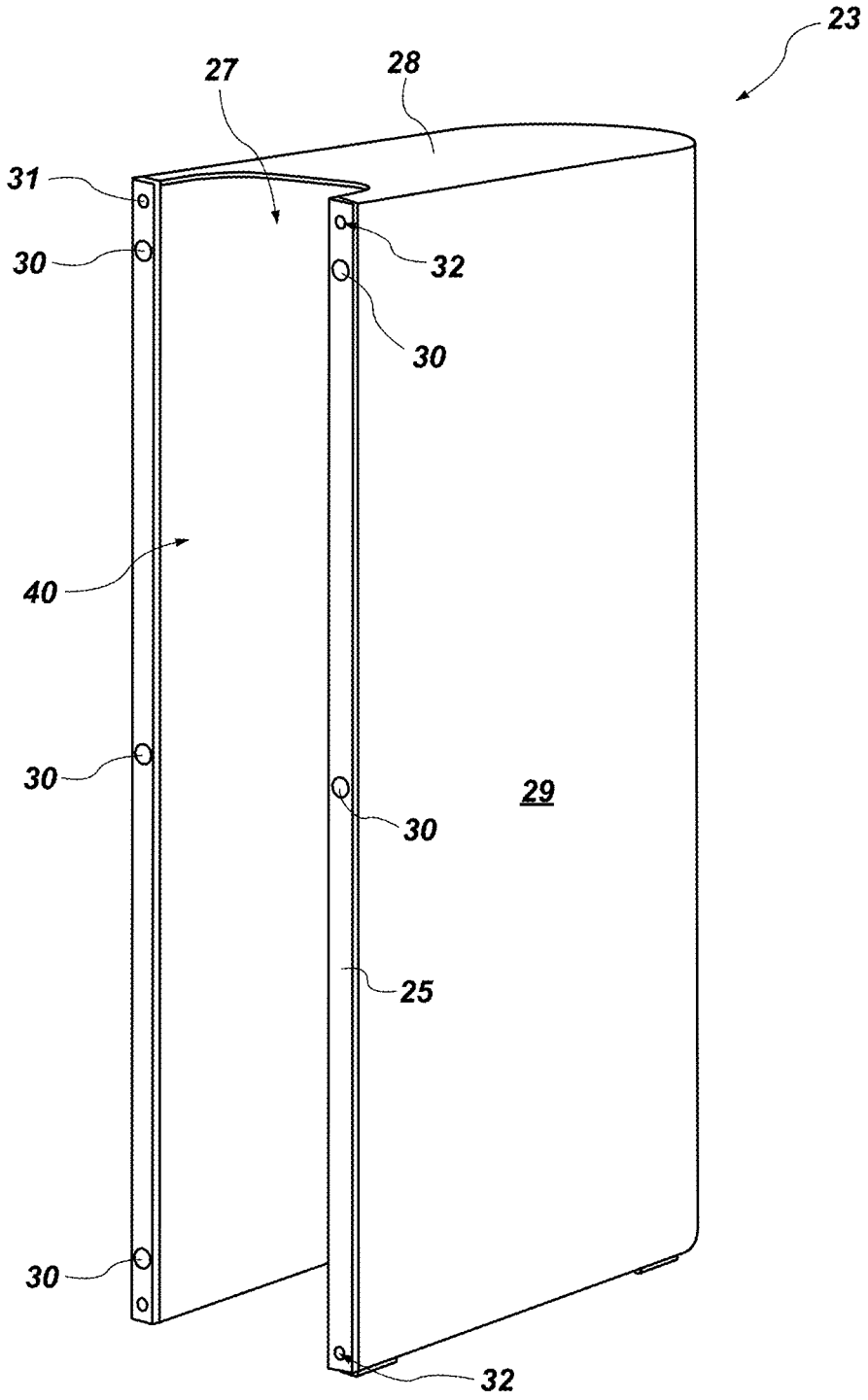
FIG. 10 illustrates a perspective view of a portion of the base for a standing desk.
Figure 11:
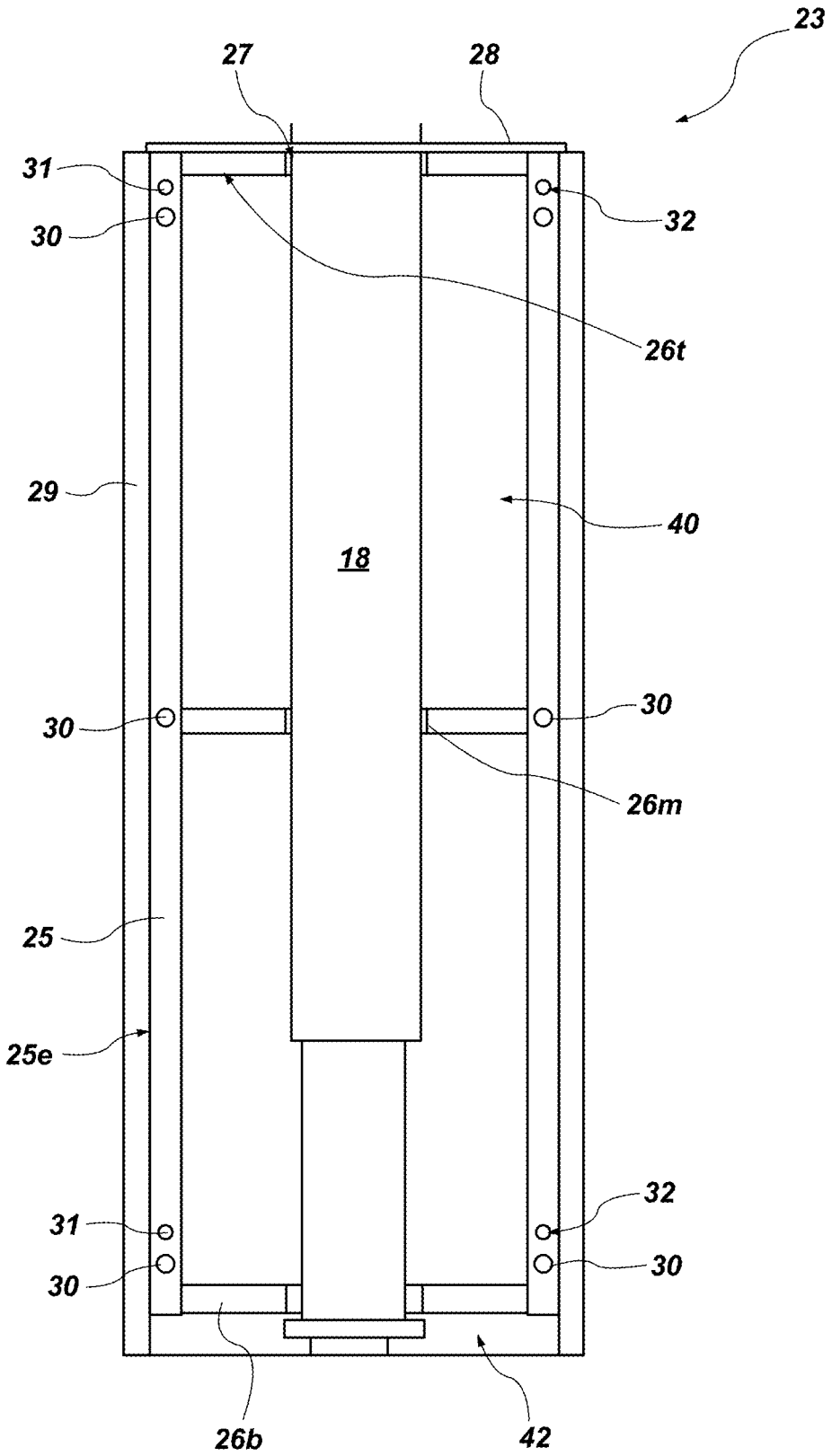
FIG. 11 illustrates a front, inside view of a portion of the base for a standing desk.

FIGS. 10 and 11 illustrate views of a portion of the first or second casing 21, 22 for a standing desk 10. Specifically, FIGS. 10 and 11 illustrate one of the first shell half 23 or the second shell half 24, where the first and second shell halves 23, 24 are substantially identical and may be interchanged with each other. Though FIGS. 10 and 11 will be discussed with reference to the first shell half 23, it is to be understood that the discussion also applies to the second shell half 24.

As illustrated in FIG. 10, the first shell half 23 includes a frame 25 and an outer cover 29 secured to the frame 25. (The outer cover 29 can also be integral to the frame 25.) In the illustrated embodiment, the frame 25 does not include tiers 26. The outer cover 29 provides a smooth, wood grain appearance. The first shell half 23 defines a cavity 40 to receive the first leg 17 or the second leg 18 of the standing desk 10. The first shell half 23 may be substantially hollow to reduce the weight of the first shell half 23. The first shell half 23 also includes the one or more connections 30 for securing and/or joining the second shell half 24 to the first shell half 23. The first shell half 23 also includes one or more pins 31 and one or more holes 32. The pins 31 are for mating with holes 32 of the second shell half 24 and the holes 32 are for mating with pins 31 on the second shell half 24. The one or more connections 30, the pins 31, and the holes 32 are all integrated into the frame 25.

As illustrated in FIG. 11, the first shell half 23 includes a frame 25 and an outer cover 29 secured to the frame 25. The frame 25 may have an exterior 25*e* to which the outer cover 29 is secured. In the illustrated embodiment, the frame 25 includes tiers 26 (a bottom tier 26*b*, a middle tier 26*m*, and a top tier 26*t*). The first shell half 23 defines a cavity 40 to receive the first leg 17 or the second leg 18 of the standing desk 10. The first shell half 23 also includes the one or more connections 30 for securing the second shell half 24 to the first shell half 23. The first shell half 23 also includes one or more pins 31 and one or more holes 32. The pins 31 are for mating with holes 32 of the second shell half 24 and the holes 32 are for mating with pins 31 on the second shell half 24. The one or more connections 30, the pins 31, and the holes 32 are all integrated into the frame 25. The "bottomless" configuration of the first shell half 23 (and, thus, the first casing 21) is clearly illustrated, where the bottom cavity 42 is clearly illustrated. The bottom cavity 42 is formed and defined by the outer cover 29 and the bottom tier 26*b*. The bottom cavity 42 accommodates the base 17*b*, 18*b* of the leg 17, 18 housed or encased by the first shell half 23 and the first casing 21 (or, the second shell half 24 or the second casing 22).

Figure 12:
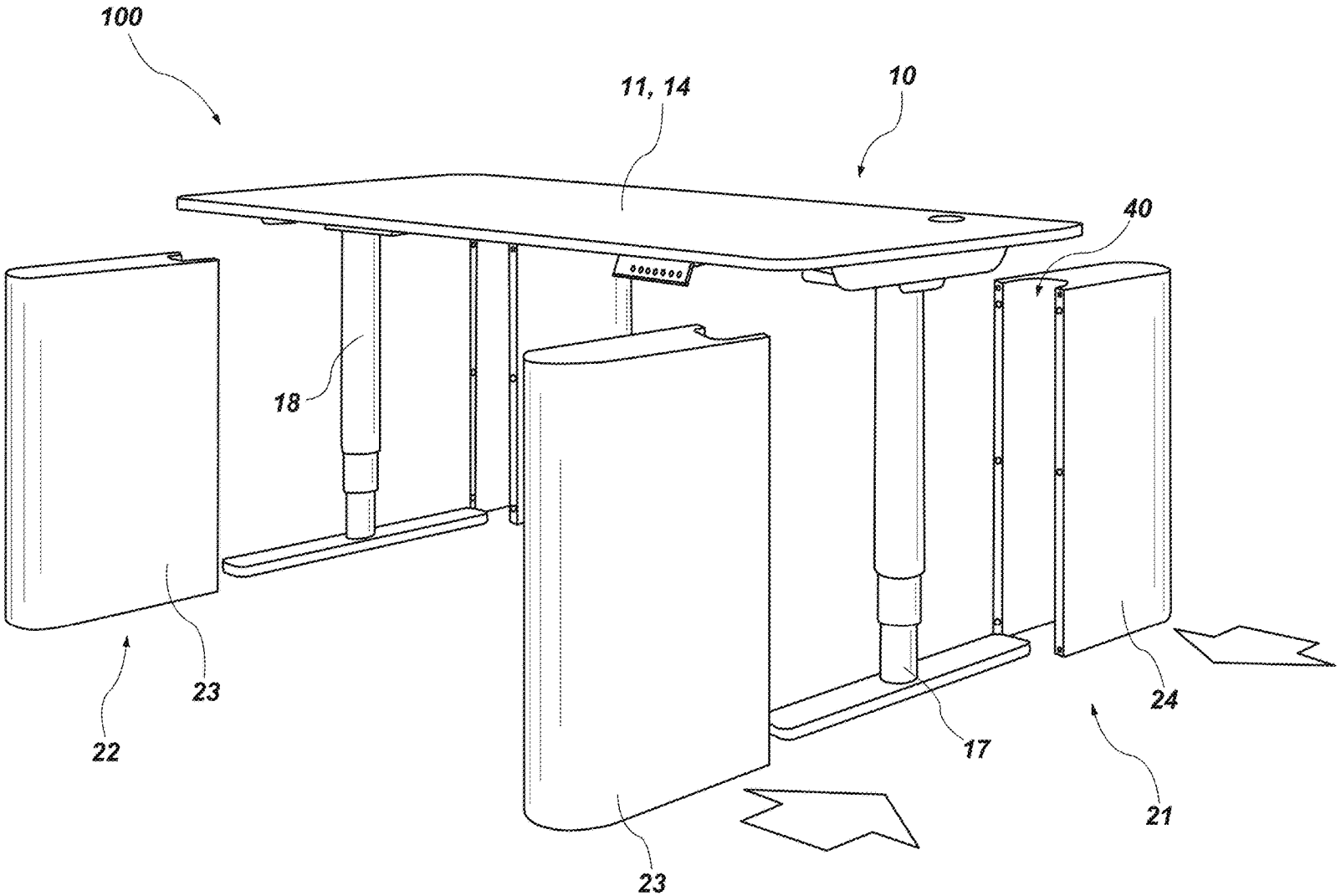
FIG. 12 illustrates a partially exploded view of the standing desk of FIG. 1.
Figure 13:
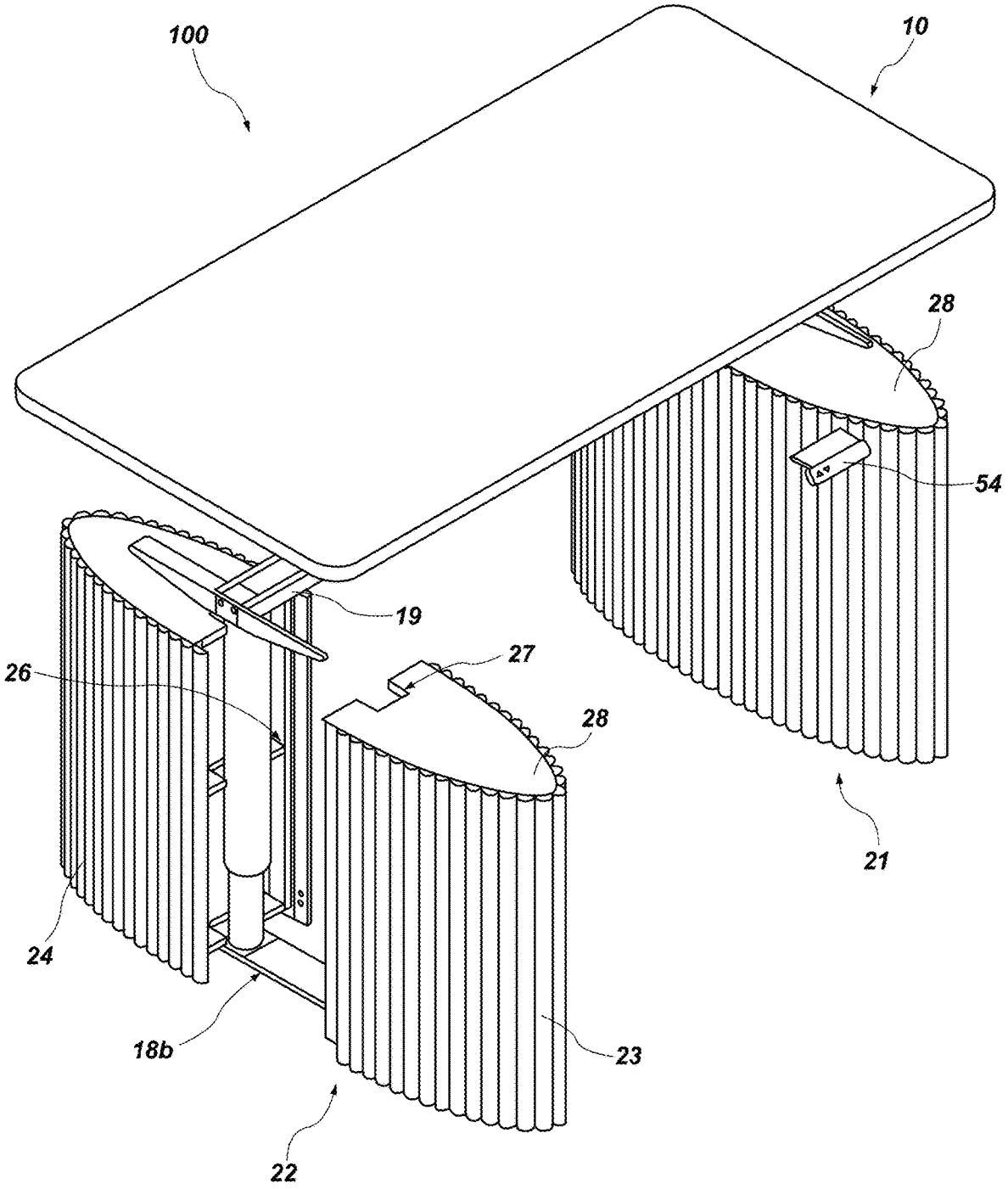
FIG. 13 illustrates another partially exploded view of the standing desk.

FIGS. 12 and 13 illustrate partially exploded views of the standing desk system 100 of FIG. 1, showing how the first and second shell halves 23, 24 come together to form the (i) first and second casings 21, 22 and (ii) the modular base 20. The cavity 40 formed from the first and second shell halves 23, 24 is clearly illustrated and it can readily be seen how the legs 17, 18 of the standing desk 10 can be housed and encased by the first and second casings 21, 22, respectively. As before, the legs 17, 18 of the standing desk 10 are telescoping legs and the encasement of the legs 17, 18 within the first and/or second casings 21, 22 preserves the telescoping function and capabilities of the legs 17, 18.

The first shell half 23 is removably connectable to the second shell half 24. For example, as outlined with respect to FIGS. 10 and 11, each of the first shell half 23 and the second shell half 24 carry one or more connectors 30 (clips, snaps, pins, magnets, joints, or any other suitable connector) that allow the first shell half 23 to be removably connected or coupled to the second shell half 24. In some embodiments, the strength of the connections 30 can be supplemented by one or more pins or dowels 31 that are received or mate with one or more corresponding holes 32. The first shell half 23 is substantially identical and interchangeable with the second shell half 24. Likewise, the first casing 21 is substantially identical and interchangeable with the second casing 22. That is, neither of the first shell half 23, the second shell half 24, the first casing 21, and/or the second casing 22 have a left or right handedness, meaning each element could be associated or disposed about the first leg 17 and/or the second leg 18. In this way, the modular base 20 is fully and completely modular, where elements can be switched out when they are broken, when a different decorative design is desired, etc.

Figure 15A:
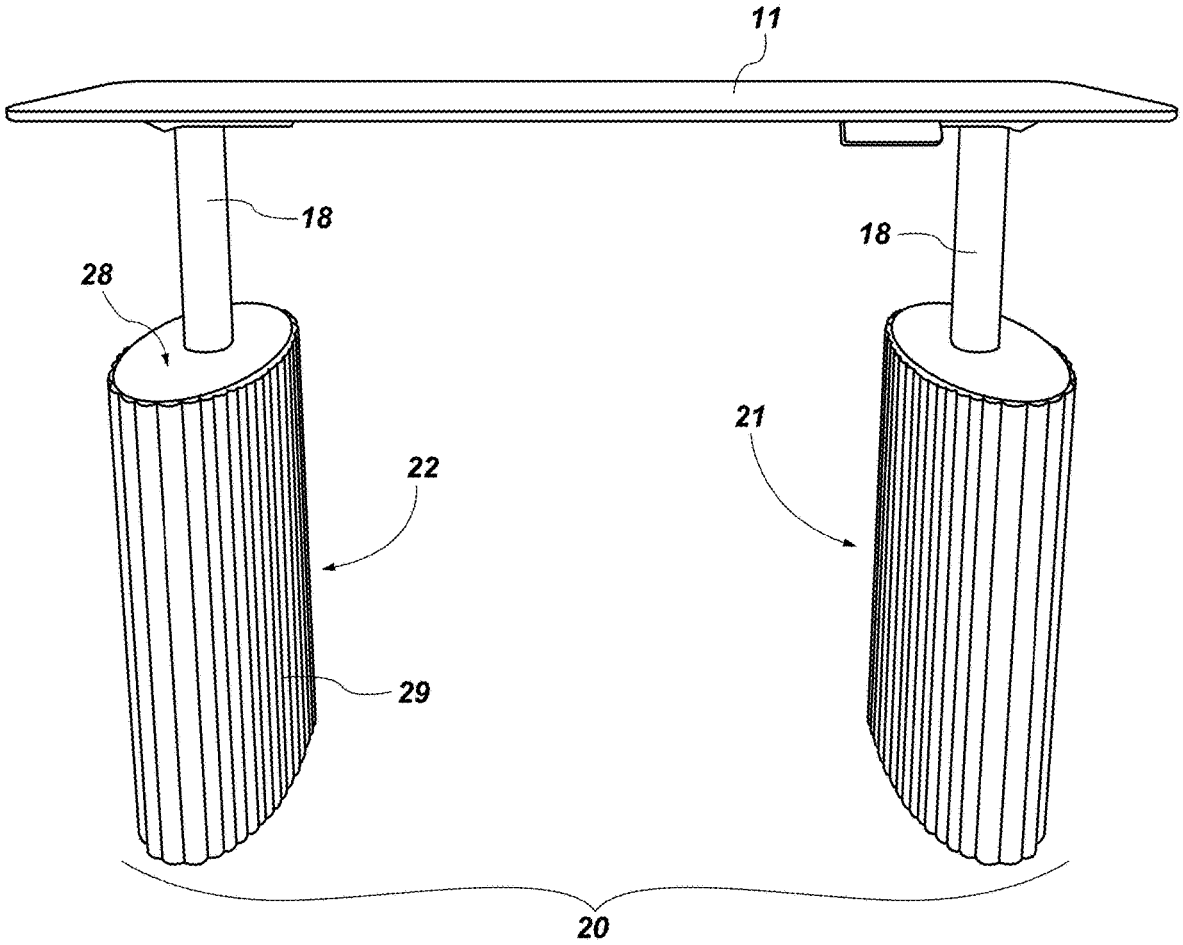
FIG. 15A illustrates the standing desk of FIG. 13 in an extended position and FIG. 15B illustrates a close-up view of a leg of the standing desk and the base.
Figure 15B:
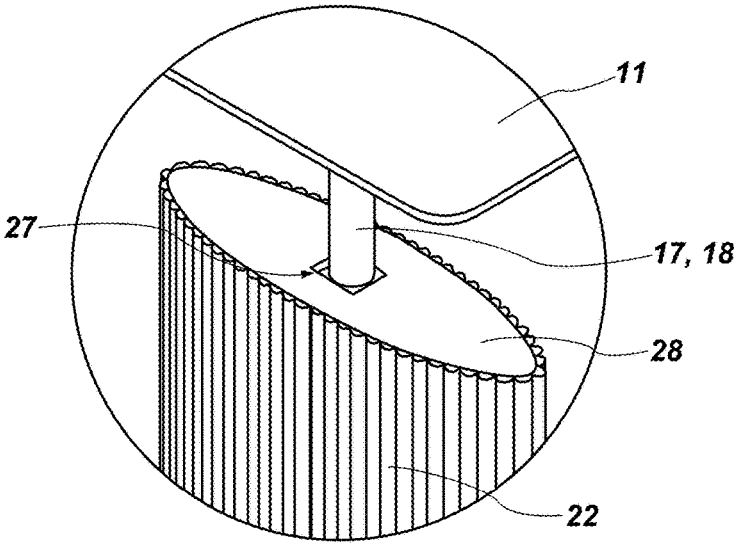

FIGS. 14A through 15A illustrate the standing desk system 100 of FIG. 1 in an extended position and FIG. 15B illustrates a close-up view of a leg 18 of the standing desk 10 and a portion of the modular base 20. The legs 17, 18 of the standing desk 10 are telescoping and allow the standing desk 10 to be placed at a myriad of different operational heights. In some embodiments, controls 54 are incorporated into the standing desk 10, such as attached to the desktop 11, which cause the legs 17, 18 to extend or contract based on a desired operational height for the standing desk 10. The controls 54 may include buttons, switches, toggles, slides, or any appropriate mechanism to activate the legs 17, 18. Additionally, and/or alternatively, the controls 54 may be accessible or in communication with a mobile device software application that allows a user of the standing desk 10 to wirelessly control or set the operational height for the standing desk 10.

When the legs 17, 18 are in an extended position, at least a portion of the legs 17, 18 extends beyond the top or finishing plate 28 of the modular base 20. As before, the top plate 28 (and any tiers 26 incorporated into the first and/or second casings 21, 22) defines a cut-out 27 sized and shaped to accommodate the legs 17, 18. It is through this cut-out 27 that the legs 17, 18 extend beyond the top plate 28 of the modular base 20. This relationship between the cut-out 27, the top plate 28, and the legs 17, 18 is clearly illustrated in FIG. 15B. In this way, the modular base 20 preserves the telescoping function and nature of the legs 17, 18 and the standing desk 10 more generally.

Figure 16A:
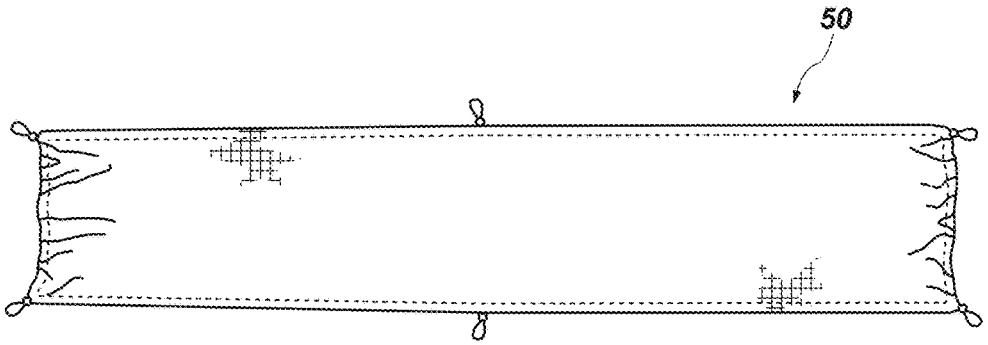
FIG. 16A illustrates an accessory net and FIG. 16B illustrates the accessory net attached to a bottom of a standing desk.
Figure 16B:
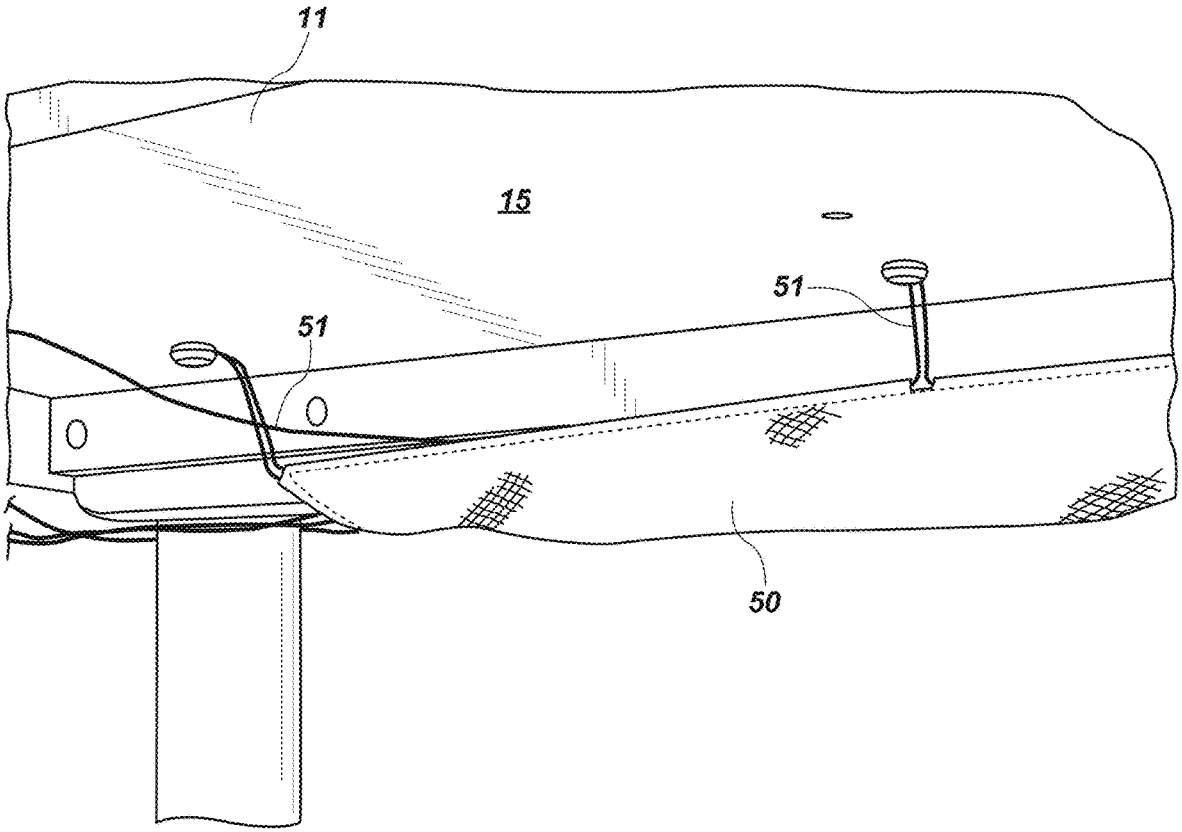

FIG. 16A illustrates an accessory net 50 and FIG. 16B illustrates the accessory net 50 attached to the bottom surface 15 of a desktop 11 of a standing desk 10, such as the standing desk 10 of any of FIGS. 1 through 15B. The accessory net 50 may be mesh or may be formed of any appropriate material for holding and organizing accessories, such as cables. The accessory net 50 may be attached to the bottom surface 15 of the standing desk 10 through one or more tethers 51. In some embodiments, the tethers 51 attach directly to the bottom surface 15; alternatively, the tethers 51 may be attached to suction cups or rivets to thereby secure the tethers 51 to the bottom surface 15 of the desktop 11.

In addition to an accessory net, the standing desk system 100 can have other functionalities built-in. For example, one or more shelves may be built into a first casing 21 or a second casing 22. Drawers, pull-out shelves, open shelves, etc., maybe attachable or integral to a first casing 21 or a second casing 22. Depending on the desired aesthetic, the functionality can be hidden or in view.

One or more parts of the system 100 can be provided as a knock-down kit, such as the pieces to form the first casing 21 and second casing 22. In these configurations, a user who already owns a standard stand-up desk can purchase a knock-down kit and install the first casing 21 and second casing 22 to provide a base to their stand-up desk.

Figure 17:
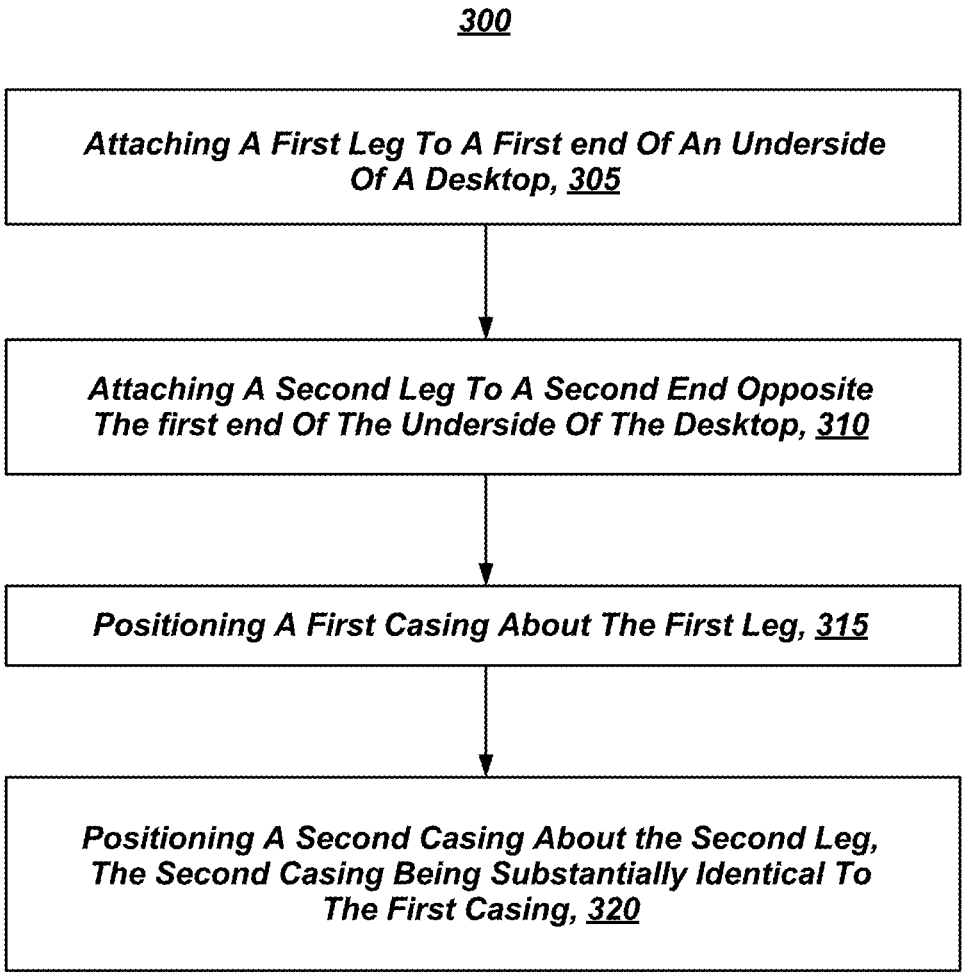
FIG. 17 illustrates a flowchart of an example method of assembling a standing desk.
Figure 18A:
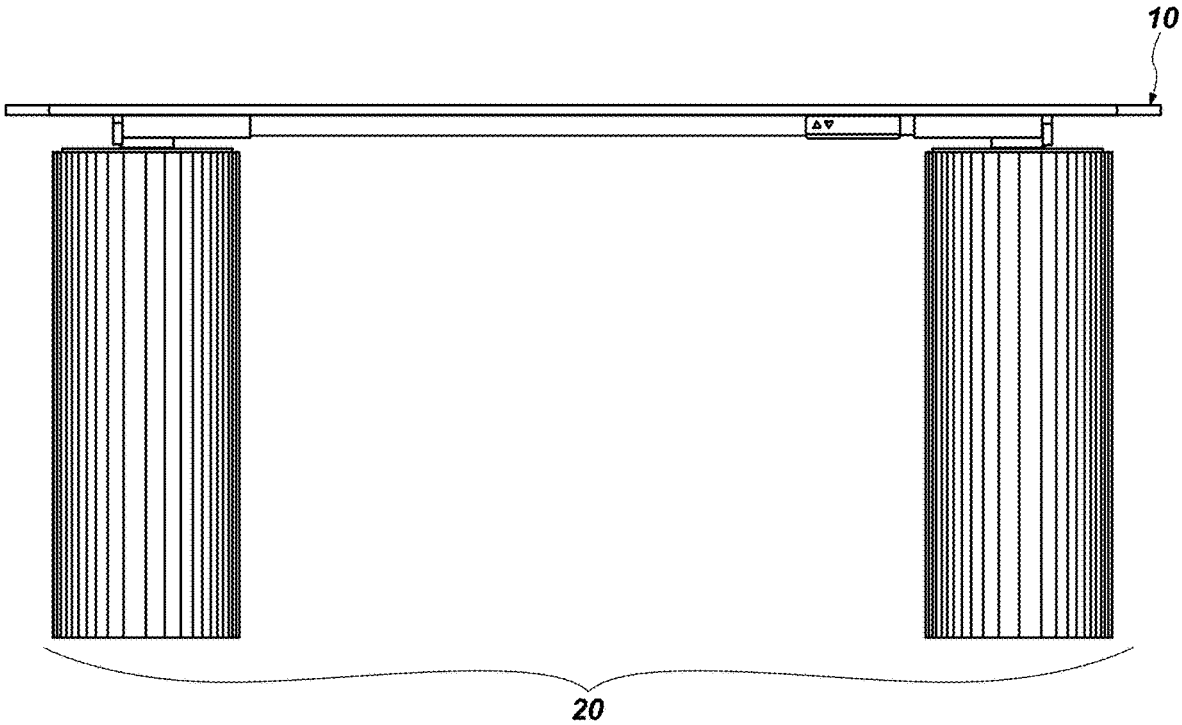
FIG. 18A illustrates a front view of standing desk having a modular base.
Figure 18B:
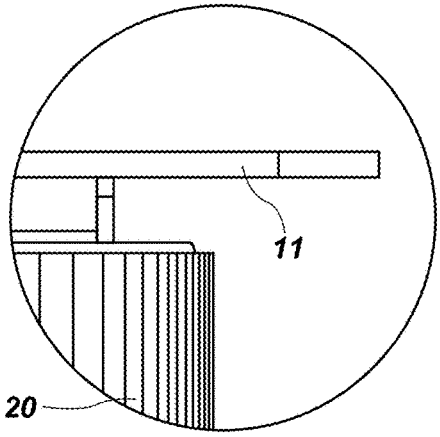
FIG. 18B illustrates a close-up view of a portion of FIG. 18A.
Figure 18C:
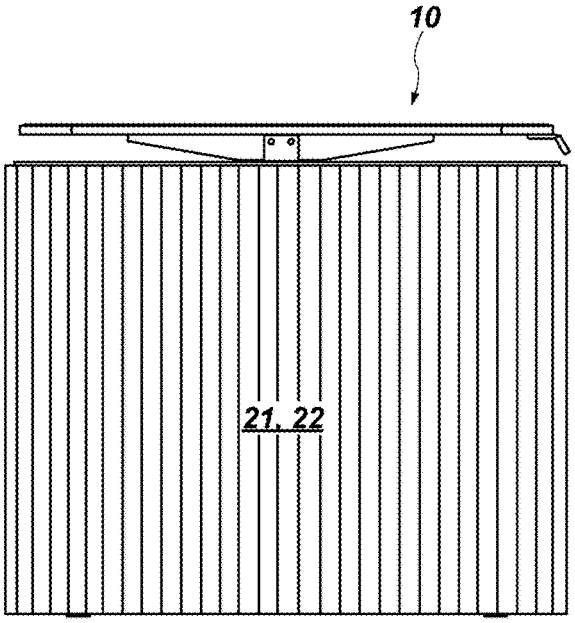
FIG. 18C illustrates an end view of the standing desk of FIG. 18A.
Figure 19A:
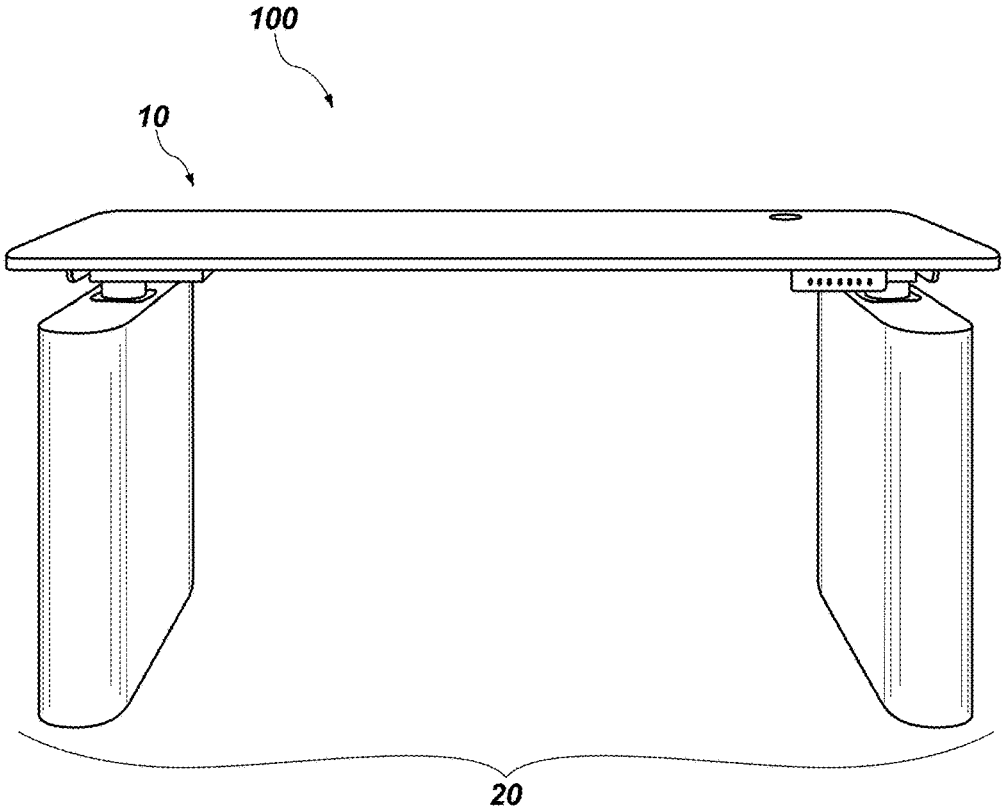
FIGS. 19A-19B illustrate perspective views of a standing desk having a base.
Figure 19B:
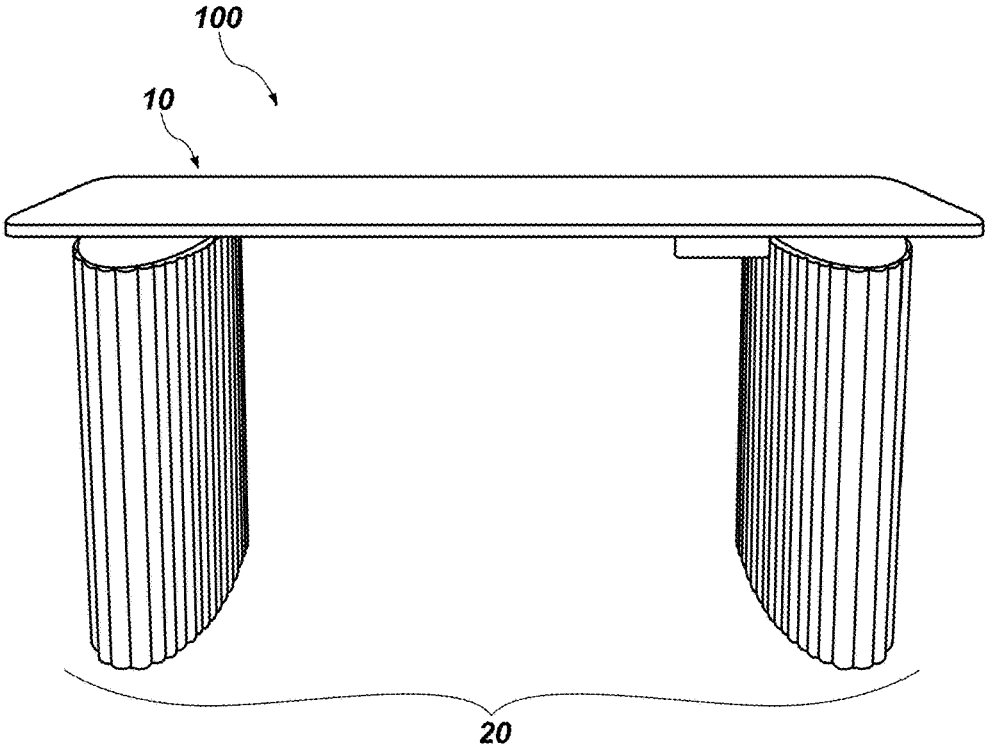
Figure 20A:
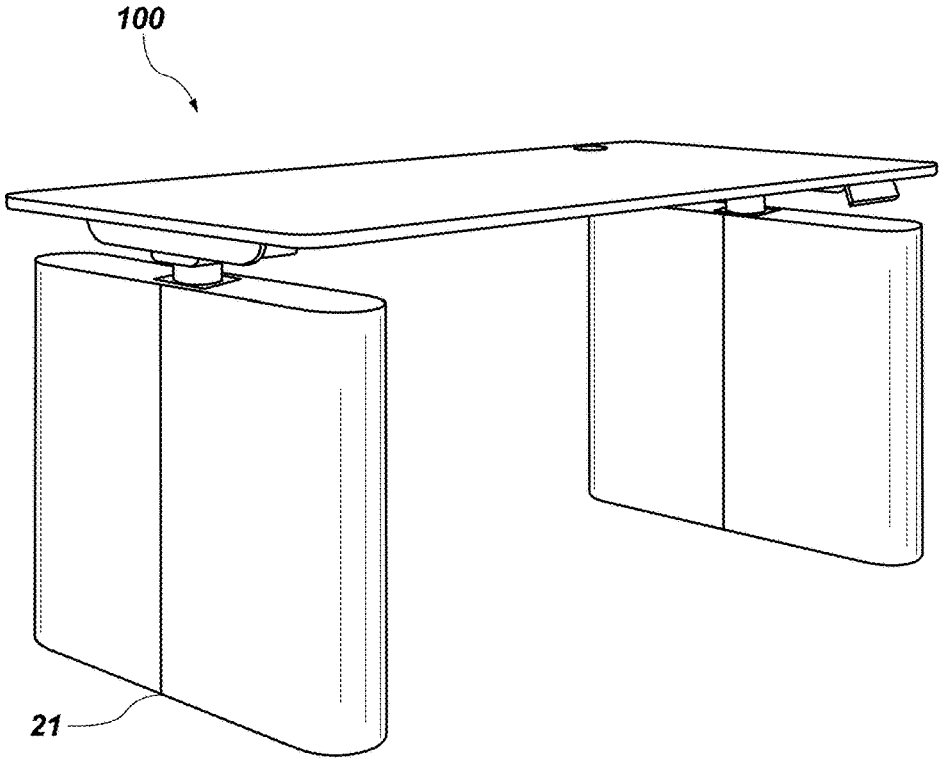
FIGS. 20A-20B illustrate end perspective views of a standing desk having a base.
Figure 20B:
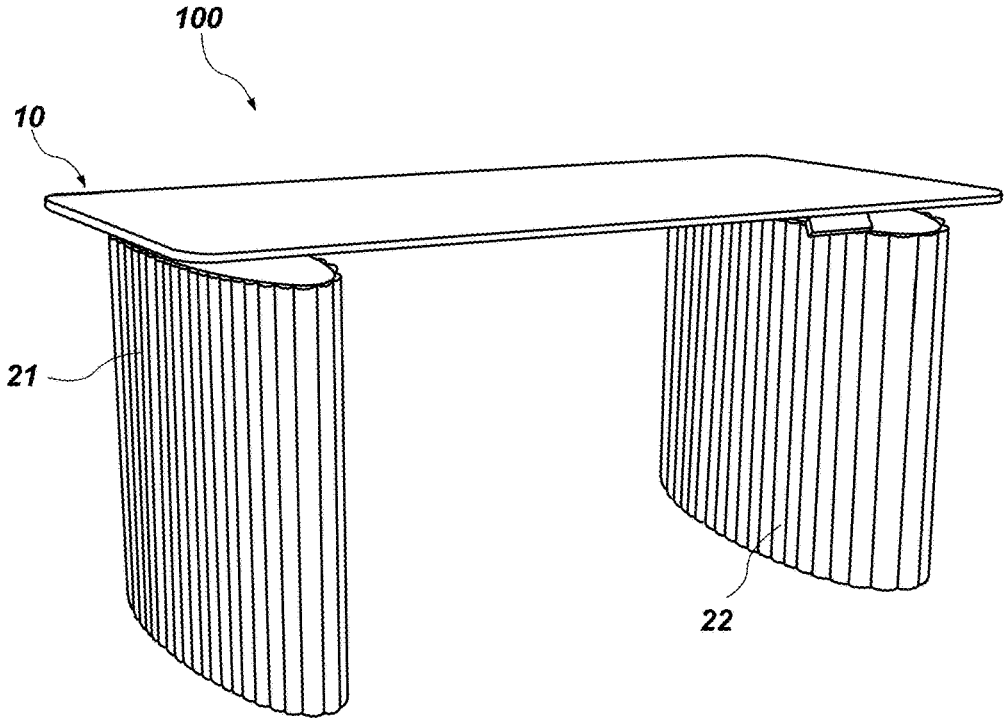
Figure 21A:
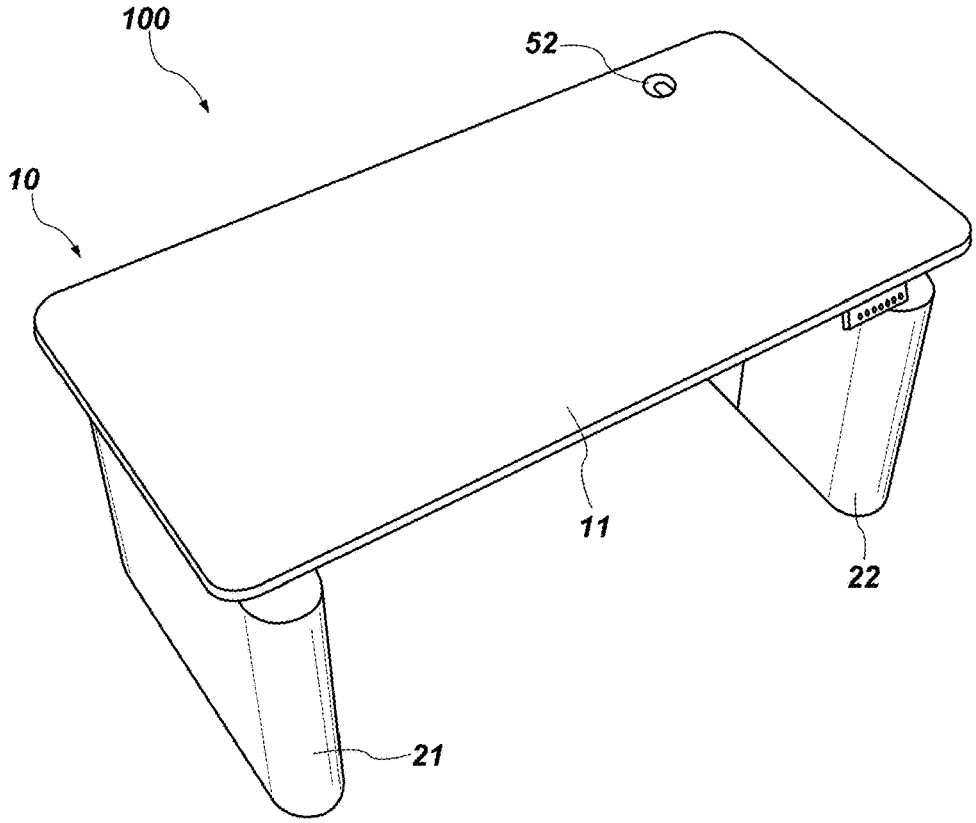
FIGS. 21A-21B illustrate perspective and end views, respectively, of a standing desk having a base.
Figure 21B:
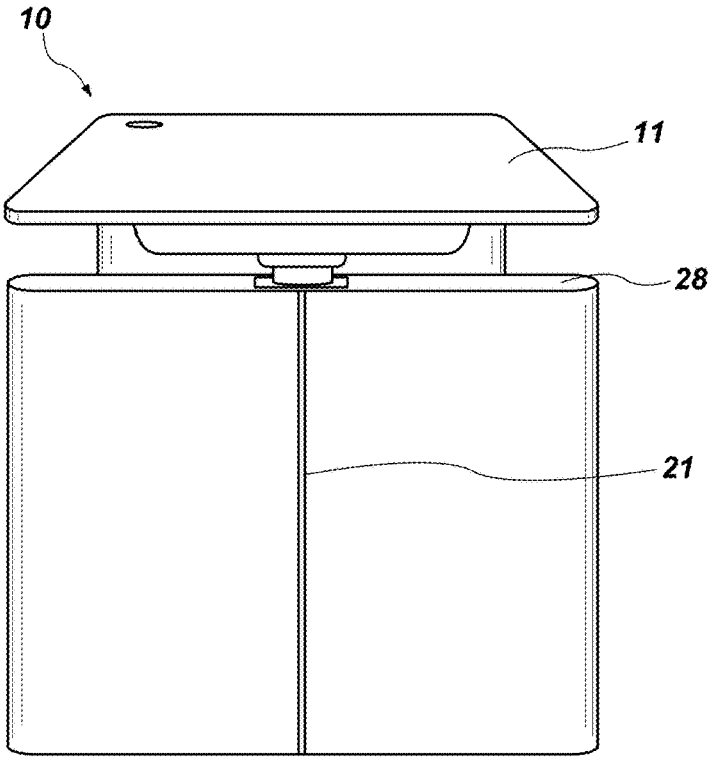

FIG. 17 illustrates a flowchart of an example method 300 of assembling a standing desk. The method 300 may include attaching a first leg to a first end of an underside of a desktop, at 305, and attaching a second leg to a second end opposite the first end of the underside of the desktop, at 310. The desktop may be the desktop 11 of the standing desk 10 of FIGS. 1-9. Accordingly, the first leg may be the first leg 17 and the second leg may be the second leg 18. The first and second legs 17, 18 may be attachable to the underside of the desktop 11 through a mount or frame 19. Alternatively, the first and second legs 17, 18 may be directly attachable to the underside of the desktop 11 without an intervening mount or frame 19.

The method 300 may also include positioning a first casing about the first leg, at 315. The first casing may be the first casing 21 of FIGS. 1-15A. Specifically, the first casing 21 may include a first shell half having a frame and an outer cover, and a second shell half connectable to the first shell half and having a frame and an outer cover. The method 300 may further include positioning a second casing about the second leg, where the second casing is substantially identical to the first casing, at 320. When the first and second casings are positioned about the first and second legs, respectively, the first and second casings for a decorative base for the standing desk.

In some embodiments, positioning the first casing about the first leg includes placing the first shell half about the first leg and mechanically attaching the second shell half to the first shell half. The first and/or second casings may be bottomless to accommodate the fist and/or second legs of the standing desk (see FIGS. 2, 9, 11, and 13).

Though the method 300 has been described herein in a particular order, it is to be understood that the method 300 and any other methods of the present disclosure can be performed in any order or an order different than that recited. Additionally, steps of the method may be performed and executed simultaneously or substantially simultaneously.

FIGS. 18A through 21B illustrate various other views of the standing desk system 100, including the standing desk 10 and the modular base 20. For example, FIG. 18B illustrates a thickness of the desktop 11, where the thickness ranges from approximately 1.3 cm to about 2.5 cm, such as 1.5, 1.7, 1.9, 2.1, 2.3 cm, or a thickness within a range defined by any two of the foregoing values.

Additional Terms and Definitions

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to a particular desk (e.g., a standing desk); however, other structures (e.g., static desks, tables, storage cabinets, etc.) are also contemplated.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A modular standing desk comprising:
- a desktop;
- a first leg extending from a base of the desktop;
- a second leg extending from the base of the desktop, the first and second legs symmetrically extending from the base;
- a first casing removably surrounding the first leg, the first casing defining an open bottom such that a base portion of the first leg contacts a ground on which the modular standing desk is positioned, the first casing comprising:
  - a first shell comprising a first frame, a first top plate attachable to the first frame, and a first outer cover disposed about an exterior of the first frame; and
  - a second shell comprising a second frame, a second top plate attachable to the second frame, and a second outer cover disposed about an exterior of the second frame,
  - the second shell joinable to the first shell and being substantially a mirror image of the first shell; and
- a second casing removably surrounding the second leg, the first and second casings easing being substantially identical and interchangeable with each other, the second casing defining an open bottom such that a base portion of the second leg contacts a ground on which the modular standing desk is positioned.

2. The modular standing desk of claim 1, wherein the first top plate is integral to the first frame and the first outer cover is integral to the first frame.

3. The modular standing desk of claim 1, wherein the second casing comprises:
- a first shell comprising a first frame, a first top plate attachable to the first frame, and a first outer cover disposed about an exterior of the first frame; and
- a second shell comprising a second frame, a second top plate attachable to the second frame, and a second outer cover disposed about an exterior of the second frame,
- the second shell joinable to the first shell and being substantially a mirror image of the first shell.

4. The modular standing desk of claim 3, wherein the second shell is magnetically connectable to the first shell.

5. A standing desk kit comprising:
- a desktop;
- a pair of legs attachable to the desktop; and
- a decorative base for covering at least a portion of each leg of the pair of legs, the base comprising:
  - a first shell for encasing a first leg, the first shell comprising a first half and a second half connectable to the first half, each of the first half and the second half having a frame and a decorative outer cover, and
  - a second shell for encasing a second leg,
- wherein the first shell and the second shell are interchangeable with each other,
- wherein at least one of the first shell and the second shell includes hidden storage, and wherein each of the first shell and the second shell defines an open bottom to accommodate the pair of legs, the open bottom to allow bases of the pair of legs to contact a ground on which the standing desk is placed.

6. The standing desk kit of claim 5, wherein the second half is connectable to the first half of the first shell through one or more of a detent, dowels, and magnets.

7. The standing desk kit of claim 5, wherein the second shell comprises:

a first half having a frame and an outer cover; and a second half connectable to the first half, the second half having a frame and an outer cover, wherein the outer cover is decorative.

8. The standing desk kit of claim 7, wherein the second half is magnetically connectable to the first half of the second shell.

9. The standing desk kit of claim 5, wherein the first shell and the second shell can be positioned about the first leg and second leg, respectively, without power tools.

10. The standing desk kit of claim 5, further comprising an accessory net attachable to a bottom of the desktop.

11. The standing desk kit of claim 5, further comprising fasteners for attaching the pair of legs to the desktop.

12. A method of assembling a standing desk, the method comprising:

attaching a first leg to a first end of an underside of a desktop;

attaching a second leg to a second end opposite the first end of the underside of the desktop;

positioning a first casing about the first leg, the first casing comprising:

a first shell half having a frame and an outer cover; and a second shell half connectable to the first shell half, the second half having a frame and an outer cover, the first casing having an open bottom allowing a base of the first leg to extend through the open bottom and contact a ground on which the standing desk is placed; and positioning a second casing about the second leg, the second casing being substantially identical to the first casing, the first and second casings forming a decorative base for the standing desk.

13. The method of claim 12, wherein the first casing is bottomless to accommodate the first leg of the standing desk.

14. The method of claim 12, wherein positioning a first casing about the first leg comprises:

placing the first shell half about the first leg; and mechanically attaching the second shell half to the first shell half.

* * * * *